US011191303B2

(12) United States Patent
Fu et al.

(10) Patent No.: US 11,191,303 B2
(45) Date of Patent: Dec. 7, 2021

(54) ATOMIZER AND ELECTRONIC CIGARETTE HAVING SAME

(71) Applicant: Shenzhen First Union Technology Co., Ltd., Shenzhen (CN)

(72) Inventors: Jiaqi Fu, Shenzhen (CN); Zhengfa Li, Shenzhen (CN); Zhongli Xu, Shenzhen (CN); Yonghai Li, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 319 days.

(21) Appl. No.: 16/371,071

(22) Filed: Mar. 31, 2019

(65) Prior Publication Data

US 2019/0297946 A1 Oct. 3, 2019

(30) Foreign Application Priority Data

Mar. 30, 2018 (CN) ..... 201810291130.3
Mar. 30, 2018 (CN) ..... 201820465368.9

(51) Int. Cl.

| | |
|---|---|
| ***A24F 40/46*** | (2020.01) |
| ***H05B 3/44*** | (2006.01) |
| ***A24F 40/44*** | (2020.01) |
| ***A24F 40/485*** | (2020.01) |
| ***A24F 15/015*** | (2020.01) |
| ***A24F 40/10*** | (2020.01) |

(52) U.S. Cl.

CPC ..... *A24F 40/46* (2020.01); *A24F 40/44* (2020.01); *A24F 40/485* (2020.01); *H05B 3/44* (2013.01); *A24F 15/015* (2020.01); *A24F 40/10* (2020.01); *H05B 2203/021* (2013.01)

(58) Field of Classification Search

CPC ..... A24F 40/30; A24F 40/485; A24F 40/46
See application file for complete search history.

(56) References Cited

U.S. PATENT DOCUMENTS

2018/0042299 A1* 2/2018 Han ..... A24F 40/30

FOREIGN PATENT DOCUMENTS

| | | | | |
|---|---|---|---|---|
| EP | 2 319 334 A1 | | 5/2011 | |
| WO | 20150120588 A1 | | 8/2015 | |
| WO | 20150140012 A1 | | 9/2015 | |
| WO | WO-2016119225 A1 | * | 8/2016 | ..... A24F 40/485 |
| WO | WO-2017051150 A1 | * | 3/2017 | ..... A61M 11/042 |

* cited by examiner

*Primary Examiner* — Jean F Duverne
(74) *Attorney, Agent, or Firm* — Proi Intellectual Property US; Klaus Michael Schmid

(57) ABSTRACT

An atomizer is provided including an atomizing body, having a proximal end, a distal end opposite to the proximal end, a longitudinal axis between the proximal end and the distal end, and a transverse axis perpendicular to the longitudinal axis; an aerosol outlet adjacent to the proximal end of the atomizing body; an air inlet bored at a lateral surface of the atomizing body; a gas pathway within the atomizing body and adjacent to the proximal end of the atomizing body; the gas pathway intercommunicating with the air inlet and the aerosol outlet; a reservoir within the atomizing body and adjacent to the distal end of the atomizing body, the reservoir configured to store tobacco liquid; a heater configured for heating the tobacco liquid to generate an aerosol; the heater being disposed inside the gas pathway; a liquid conductor, extending towards the proximal end of the atomizing body.

19 Claims, 13 Drawing Sheets

ATOMIZER AND ELECTRONIC CIGARETTE HAVING SAME

TECHNICAL FIELD

The present disclosure relates to the field of electronic cigarettes, and particularly to an atomizer and an electronic cigarette having same.

BACKGROUND ART

The electronic cigarette containing tobacco liquid generates an aerosol mist or vapour generated by typically heating the tobacco liquid, generally encompasses a power supply module and an atomizer, of which, the atomizer includes a gas-inlet pathway, a gas-outlet pathway, a heater, a liquid conductor and a reservoir. By means of the liquid conductor, the atomizer transfers the tobacco liquid in the reservoir to the heater for heating and atomizing, exterior air flowing in through the gas-inlet pathway bears the atomized tobacco liquid, then expelled through the gas-outlet pathway to form the aerosol mist or vapour.

In the prior art atomizers with a lower gas-inlet configuration, the liquid conductor surrounding the heater is disposed inside the gas-outlet pathway, the reservoir surrounds the liquid conductor as well as the heater, the gas-inlet pathway is disposed below the heater and the liquid conductor, the liquid conductor transfers the tobacco liquid from a lateral surface thereof to the heater for heating. However, during the process of inventors' research, one area of particular concern to consumers and inventors is that by transferring the tobacco liquid from the lateral of the liquid conductor to the heater, when a level of the tobacco liquid in the reservoir is higher than the liquid conductor, the liquid conductor is easy to get saturated causing tobacco liquid absorbed in the liquid conductor to be expelled inadvertently from the liquid conductor under gravity force. Consequently, this transferring technique is cumbersome and results in spillages of tobacco liquid, deteriorating the user experiment.

SUMMARY

In view of the drawbacks in the prior art, the present disclosure relates to an atomizer and an electronic cigarette having the same, which are capable of resolving spillages of tobacco liquid and improving user experiment.

In order to solve the above technical problem, the present disclosure provides an atomizer according to independent claim 1 whereas various embodiments of an atomizer and improvements thereto are recited in the dependent claims. An atomizer includes: an atomizing body, having a proximal end, a distal end opposite to the proximal end, a longitudinal axis between the proximal end and the distal end, and a transverse axis that is perpendicular to the longitudinal axis;

an aerosol outlet adjacent to the proximal end of the atomizing body; an air inlet is bored at a lateral surface of the atomizing body; a gas pathway within the atomizing body and adjacent to the proximal end of the atomizing body; the gas pathway intercommunicating with the air inlet and the aerosol outlet;

a reservoir within the atomizing body and adjacent to the distal end of the atomizing body, the reservoir configured to store tobacco liquid;

a heater, configured for heating the tobacco liquid to generate an aerosol; the heater being disposed inside the gas pathway;

a liquid conductor, extending towards the proximal end of the atomizing body to contact the heater in the gas pathway and extending towards the distal end of the atomizing body to absorb tobacco liquid from the reservoir, such that the liquid conductor is capable of supplying tobacco liquid to the heater.

As used herein, the heater configured for heating the tobacco liquid to generate an aerosol; the heater being disposed inside the gas pathway; the heater including a hollow aerosol pathway formed therein for intercommunicating with gas pathway;

As used herein, the liquid conductor includes a main portion and an extending portion; the main portion surrounding a periphery of the heater, the extending portion being extending to the reservoir and configured for absorbing tobacco liquid to the main portion such that the main portion is capable of supplying tobacco liquid to the heater.

As used herein, the atomizing body including:

a shell with a receiving chamber and a gas pathway formed therein; an air inlet and an aerosol outlet formed thereon;

a base, received in the receiving chamber and sealed up with shell;

a fixing component, received in the receiving chamber and the gas pathway being disposed inside the fixing component;

the shell, the base and the fixing component defining the reservoir.

As used herein, the gas pathway includes: a gas-inlet pathway and a gas-outlet pathway.

The gas-inlet pathway intercommunicates with the air inlet, the gas-outlet pathway intercommunicates with the gas-outlet pathway.

As used herein, the gas-inlet pathway is extending in a direction of a transverse axis; the gas-outlet pathway is extending in a direction of a longitudinal axis that is perpendicular to the transverse axis.

The liquid conductor surrounding the heater is nested within the gas-inlet pathway.

The gas-inlet pathway is bored with a first slot that intercommunicates with the gas-inlet pathway; the extending portion passing through the first slot extends to the reservoir.

As used herein, the heater is a heating tube bored with multiple openings, the heater heats the tobacco liquid to generate an aerosol that is expelled to an atomizing pathway via the multiple openings; the heating tube is provided with a first through hole whereby the atomizing pathway intercommunicates with the gas-outlet pathway.

As used herein, a number of the air inlets is two, respectively, a first air inlet and a second air inlet.

The atomizer further includes: a first plug and a second plug.

The first plug is engaged with the first air inlet, the first plug is opened with a second through hole; the first air inlet, the second through hole and the atomizing pathway intercommunicate with each other.

The second plug is engaged with the second air inlet, the second plug is opened with a third through hole; the second air inlet, the third through hole and the atomizing pathway intercommunicate with each other.

As used herein, the gas-outlet pathway has a V-shaped longitudinal section.

As used herein, the gas-inlet pathway includes a first gas-inlet pathway and a second gas-inlet pathway;

The second gas-inlet pathway is extending along a direction of the transverse axis; the first gas-inlet pathway and the gas-outlet pathway are both extending along a direction of the longitudinal axis;

The first gas-inlet pathway intercommunicates with the air inlets; the second gas-inlet pathway is bored with a second slot.

As used herein, the heater is a heating coil that is nested within the second gas-inlet pathway, and the atomizing pathway formed inside of the heating coil intercommunicates with the second gas-inlet pathway.

As used herein, the atomizer further includes a clamping component;

The clamping component has a third slot and a fourth through hole;

The main portion of the liquid conductor surrounding the heating coil is fixed by the clamping component, the atomizing pathway is corresponding with the fourth through hole; the extending portion passes through the third slot to extend into the reservoir.

The clamping component passes through the second slot to be nested within the second gas-inlet pathway.

As used herein, the second gas-inlet pathway is bored with an opening;

The atomizer further includes a third plug, the third plug is engaged with the opening as an aid to clean the gas pathway.

According to another embodiment of the present disclosure, the atomizing body including:

a shell, having a receiving chamber formed therein, an air inlet and an aerosol outlet formed thereon;

a base, comprising a first base, an extending portion and a second base; the extending portion being disposed between the first base and the second base, a length of the extending portion is less than lengths of the first base along a direction of a transverse axis; and the base being received in the receiving chamber, the first base and the second base being sealed up with the shell; the second base and the shell encompassing the gas pathway; the second base, the first base, the extending portion and the shell together define an annular reservoir.

As used herein, the base having a first receiving hole, the first receiving hole passing through the extending portion and the second base;

the liquid conductor is received in the first receiving hole.

As used herein, the extending portion is bored with a liquid conductive hole, the liquid conductive hole intercommunicates with the first receiving hole and the reservoir such that the liquid conductive hole absorbs tobacco liquid from the reservoir through the liquid conductive hole.

As used herein, the heater is a disk-shaped heater; the heater includes a heating part and a fixing part; the heater is fixed on the second base via the fixing part, and the heating part abutting the liquid conducting body.

As used herein, the fixing part is bored with a fixing hole; the base is bored with a second receiving hole, the second receiving hole passing through the first base, the extending portion and the second base; the second receiving hole is corresponding to the fixing hole.

As used herein, the atomizer further includes an electrode mast; the electrode mast passing through the fixing hole and the second receiving hole, and configured for fixing the heater to the second base and coupling the heater to a power supply module.

As used herein, the first base is bored with an injection hole configured for replenishing tobacco liquid to the reservoir.

To solve the above problem, another technology scheme is adopted by the present disclosure; an electronic cigarette is provided including: a power supply module and the aforementioned atomizer; the power supply module is coupled with the atomizer to supply power to the atomizer.

Additional aspects and advantages of the present disclosure will be: the present disclosure relates to an atomizer and an electronic cigarette having the same. The atomizer includes an atomizing body, a heater and a liquid conductor. As used herein, the atomizing body of the atomizer has a reservoir for storing tobacco liquid, a gas pathway, an air inlet and an aerosol outlet. The liquid conductor includes a main portion and an extending portion, the heater has a hollow atomizing pathway formed therein; the air inlet and the aerosol outlet respectively intercommunicate with the gas pathway that is formed above the reservoir and separated from the reservoir; the heater is nested within the gas pathway, the atomizing pathway intercommunicates with the gas pathway, the main portion of the liquid conductor surrounds the heater exclusive of the extending portion extending into the reservoir; the extending portion of the liquid conductor absorbs tobacco liquid from the reservoir at a lower position to the heater nested within the gas pathway at an upper position, making the liquid conductor not easy to get saturated, alleviating liquid deposition in the liquid conductor under gravity force. Furthermore, since the reservoir is disposed below the gas pathway, the heater and the liquid conductor, even if the liquid deposition is happened, the tobacco liquid would settle into the reservoir rather than coming into the gas pathway, which effectively resolves the leakage problem of tobacco liquid to improve user experience.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

With reference to FIGS. 1-9, 1 represents the atomizer, 10 represents the atomizing body, 11 represents the shell, 111 represents the receiving chamber, 112 represents the air inlet, 1121 represents the first air inlet, 1122 represents the second air inlet, 113 represents the aerosol outlet, 114 represents the first receiving hole, 115 represents the clamping slot, 116 represents the second receiving hole, 117 represents the third receiving hole, 12 represents the fixing component, 121 represents a flattened body, 1211 represents the gas pathway, 12111 represents the gas-inlet pathway, 12111*a* represents the first gas-inlet pathway, 12111*b* represents the second gas-inlet pathway, 12112 represents the gas-outlet pathway, 1212 represents the first groove, 1213 represents the second slot, 1214 represents the opening, 122 represents the clamping cover, 1221 represents the protrusion, 1222 represents the second groove, 13 represents the base, 131 represents the injection hole, 20 represents the heater, 21 represents the first through hole, 22 represents the atomizing pathway, 23 represents the first electrode, 24 represents the openings, 25 represents the second electrode, 30 represents the liquid conductor, 31 represents the main portion, 311 represents the fourth receiving hole; 312 represents the aerosol hole, 32 represents the extending portion, 40 represents the reservoir, 51 represents the first plug, 511 represents the second through hole, 52 represents the second plug, 521 represents the third through hole, 60 represents the leading wire, 70 represents the clamping component, 71 represents the third slot, 72 represents the fourth through hole, 80 represents the third plug, 90 represents the plug.

With reference to FIGS. 10-14, 1 represents the atomizer, 10 represents the atomizing body, 11 represents the shell, 111 represents the receiving chamber, 112 represents the air inlet, 113 represents the aerosol outlet, 114 represents the gas-outlet pathway, 12 represents the base, 121 represents the first base, 1211 represents the injection hole; 122 represents the extending portion, 1221 represents the liquid conductive hole, 123 represents the second base, 124 represents the first receiving hole, 125 represents the second receiving hole, 20 represents the liquid conductor, 30 represents the heater, 31 represents the heating part, 32 represents the fixing part, 321 represents the fixing hole, 40 represent the reservoir, 50 represents gas pathway, 60 represents the electrode mast, 61 represents the lid, 62 represents the protrusion, 70 represents the injection plug.

DETAILED DESCRIPTION

Embodiments of the present disclosure will now be described in detail below and with reference to the drawings.

Embodiment 1

Figure 1:
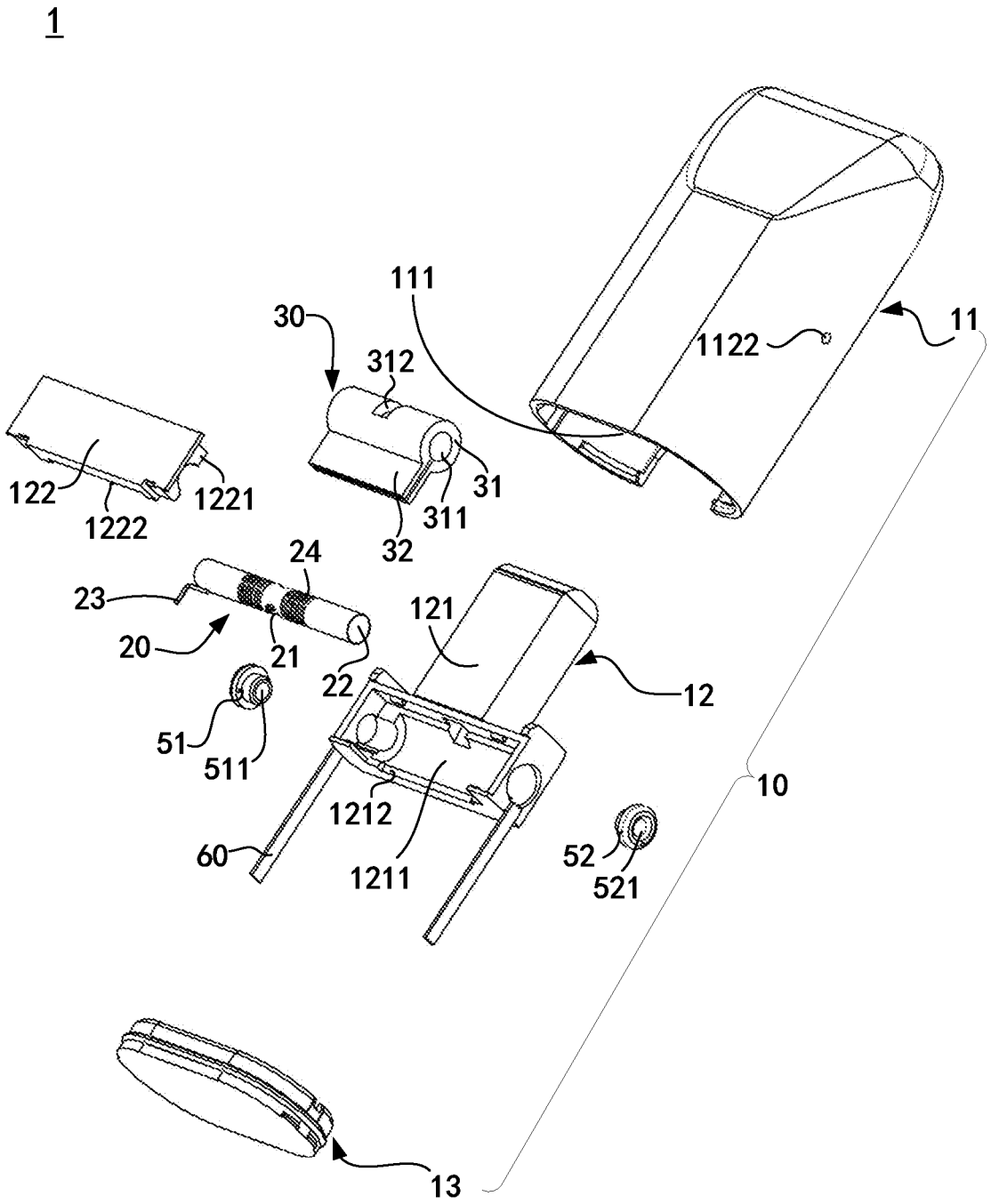
FIG. 1 is an exploded view of an atomizer in accordance with a first embodiment of the present disclosure.
Figure 2:
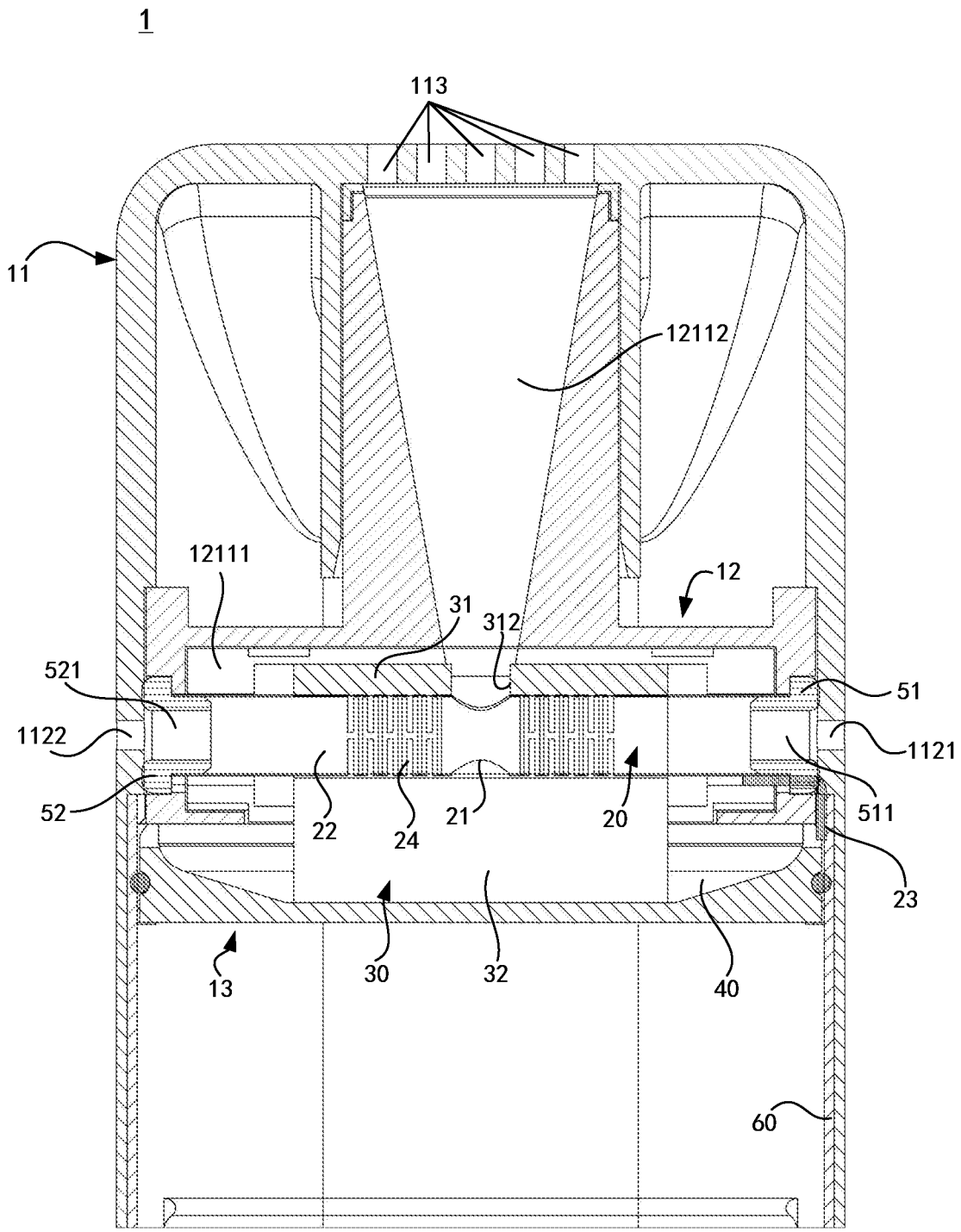
FIG. 2 is a cross-sectional view of the atomizer in accordance with the first embodiment of the present disclosure.

Referring to FIG. 1 and FIG. 2, which illustrate an atomizer in accordance with an embodiment of the present disclosure. The atomizer 1 includes an atomizing body 10, a heater 20 and a liquid conductor 30. The liquid conductor 30 surrounding the heater 20 together are received in the atomizing body 10.

More specifically, the atomizing body 10 includes: a shell 11, a fixing component 12 and a base 13.

Figure 3:
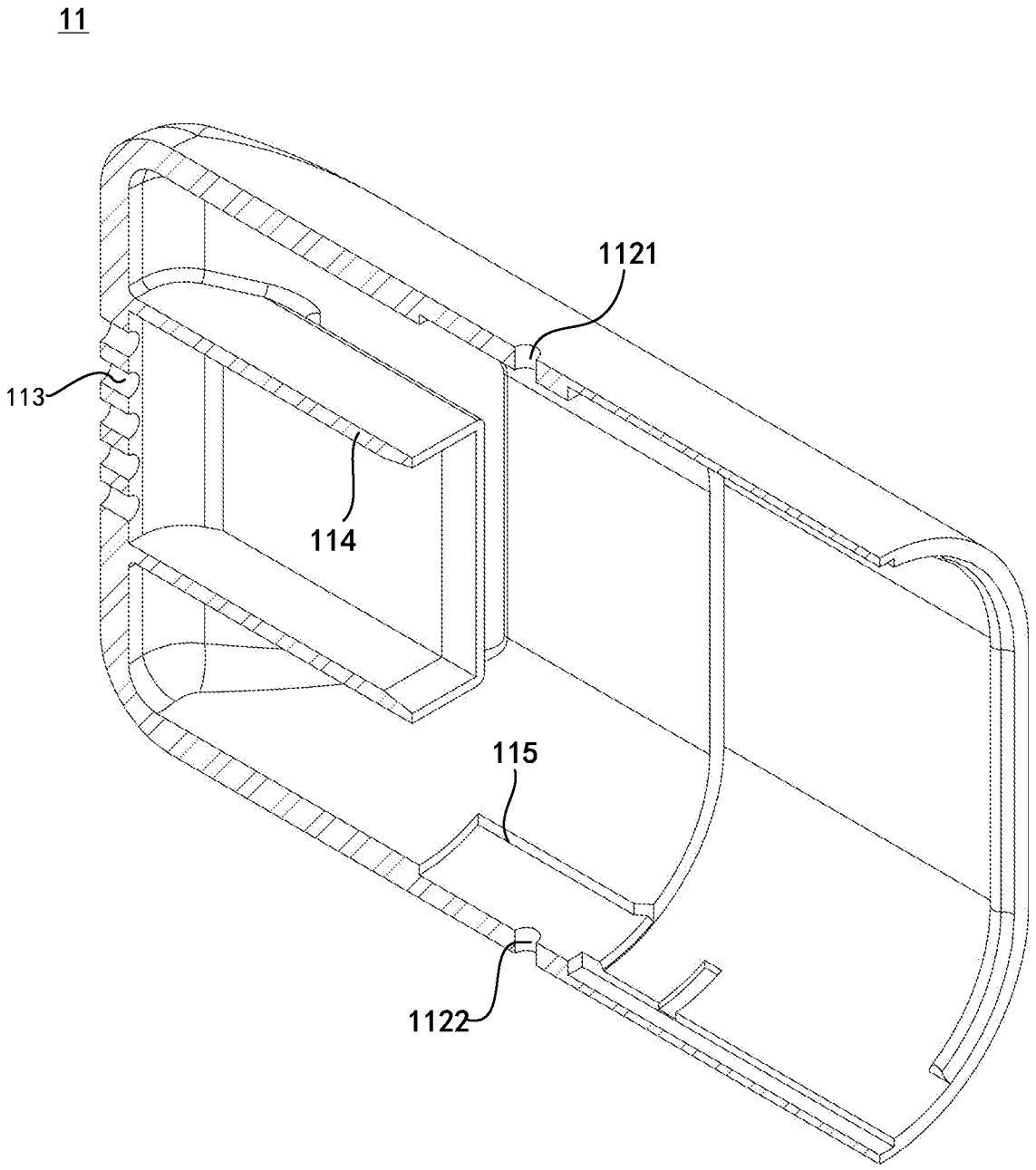
FIG. 3 is an exploded perspective view of a shell of the atomizer in accordance with the first embodiment of the present disclosure.

Referring to FIGS. 1-3, the shell 11 has a receiving chamber 111 that is formed by a sidewall (not shown) and a top wall (not shown) of the shell 11. The sidewall of the shell 11 is bored with an air inlet 112, the air inlet 112 is oriented perpendicular to the sidewall, and the air inlet 112 intercommunicates with the receiving chamber 111. The top wall of the shell 11 is opened with an aerosol outlet 113. The aerosol outlet 113 is oriented perpendicular to the top wall, and the aerosol outlet 113 intercommunicates with the receiving chamber 111, so that exterior air may enter into the atomizer 1 formed by the shell 11 along a direction of a transverse axis between two sidewalls of the shell 11 which is perpendicular to the sidewalls, and the aerosol may flow out from the top of the shell 11, thus making the flowing in the electronic cigarette more smoothly.

Furthermore, the air inlet 112 includes a first air inlet 1121 and a second air inlet 1122, respectively disposed on two opposite sidewalls and opposite with each other. Preferably, the number of the first air inlet 1121 and the number of the second air inlet 1122 are both one.

The number of the aerosol outlets 113 is multiple, which are arrayed with regularity. Preferably, several aerosol outlets 113 are disposed along a direction of the transverse axis. By replying on several aerosol outlets 113, the speed and volume of the aerosol expelled is alleviated to avoid fast speed and excessive volume of the aerosol causing the user cough.

The sidewalls bored with the first air inlet 1121 and the second air inlet 1122 are both provided with the clamping slots 115, the number of which is two.

A first receiving hole 114 is extending downwards from inside the top wall. The first receiving hole 114 is corresponding with the aerosol outlet 113.

The base 13 is received in the receiving chamber 111, a dimension of the base 13 is in consistency with that of an inner wall of the receiving chamber 111 permitting the base 13 to be riveted with the receiving chamber 111 via gasket rings.

A surface of the base 13, facing the receiving chamber 111 recesses to form the receiving chamber (not shown).

The fixing component 12 is received in the receiving chamber 111, between the shell 11 and the base 13. The fixing component 12 is fixedly connected with the clamping slots 115 and the shell 11 via the first receiving hole 114. Meanwhile, the shell 11, the fixing component 12 and the base 13 define the reservoir 40 configured for storing tobacco liquid that may be accumulated in a lower space of the reservoir 40. The lower space is almost formed by the recessed base 13.

Figure 4:
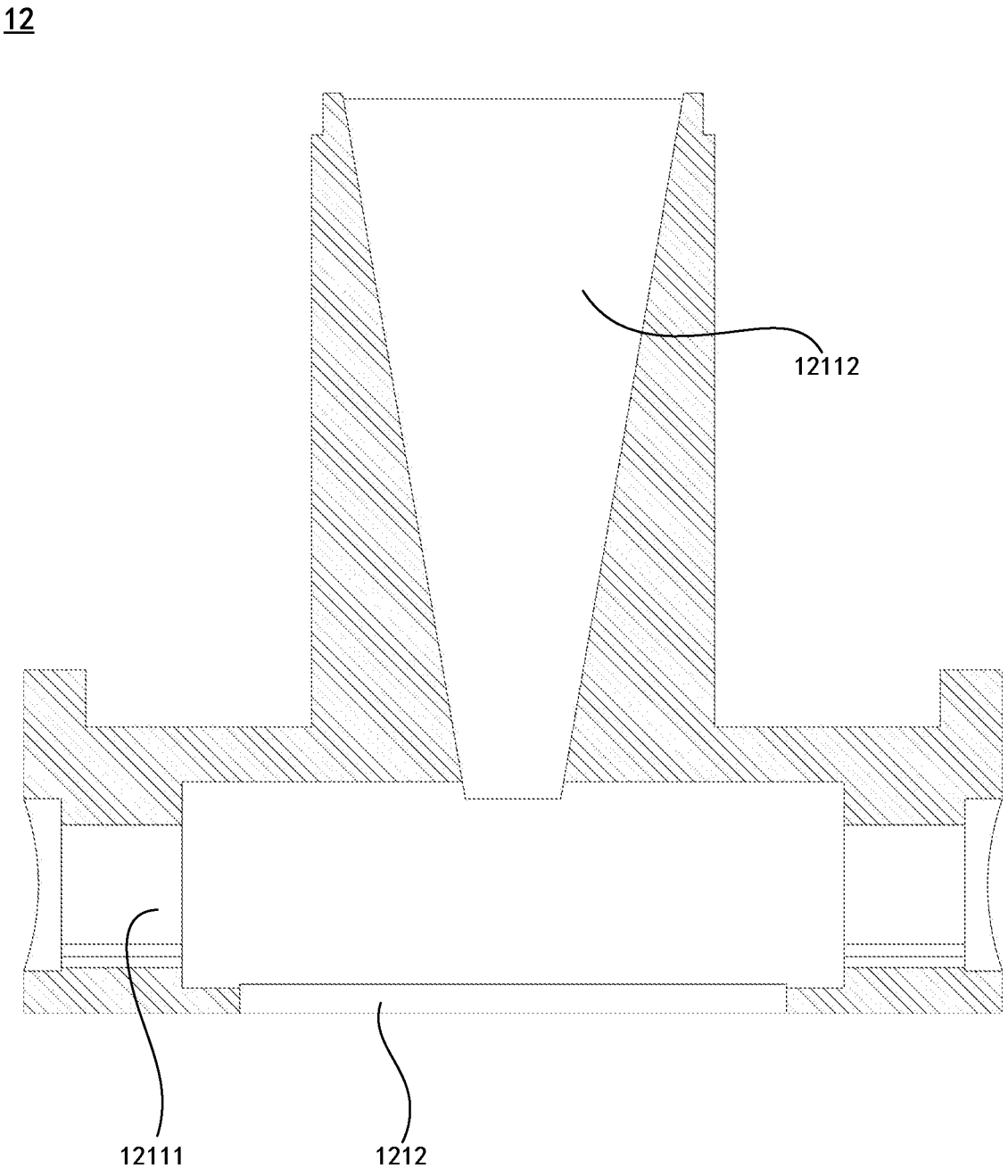
FIG. 4 is across-sectional view of a fixing component of the atomizer in accordance with the first embodiment of the present disclosure.

More specifically, referring to FIG. 1, FIG. 2 and FIG. 4, the fixing component 12 includes a flattened body 121 and a clamping cover 122.

The flattened body 121 is bored with a gas pathway 1211 and a first groove 1212.

The gas pathway 1211 includes a gas-inlet pathway 12111 and a gas-outlet pathway 12112. As used herein, the gas-inlet pathway 12111 is extending along a direction of a transverse axis, the gas-outlet pathway 12112 is extending along a direction of a longitudinal axis that is perpendicular to the transverse axis. The gas-outlet pathway 12112 intercommunicates with the gas-inlet pathway 12111. The longitudinal cross-sectional view of the gas-outlet pathway 12112 is V-shaped to effectively prevent the boiling tobacco liquid to spray to the user's mouth.

The gas-outlet pathway 12112 is formed in the flattened body 121 that is partly received in the receiving hole 114 and riveted with the receiving hole 114, permitting the gas-outlet pathway 12112 to intercommunicate with the aerosol holes 113.

Furthermore, the gas-inlet pathway 12111 has a cavity (not shown) for nesting the liquid conductor. The cavity is disposed at middle of the gas-inlet pathway 12111, intercommunicating with the gas-outlet pathway 12112.

The first groove 1212 is disposed at a bottom of the flattened body 121, intercommunicating with the gas-inlet pathway 12111 and correspondingly intercommunicate with the cavity and the gas-outlet pathway 12112.

The clamping cover 122 includes a protrusion 1221 and a second groove 1222.

The protrusion 1221 is consistent with the gas-inlet pathway 12111 disposed in the flattened body 121 in dimension, causing the protrusion 1221 to be clamped in the gas-inlet pathway 12111 to enclose the gas-inlet pathway 12111 and the cavity. Meanwhile, between the second groove 1222 and the first groove 1212 forms a first slot (not shown), the first slot is disposed at a bottom of the fixing component 12, intercommunicating with the gas-inlet pathway 12111 and the reservoir 40, accordingly intercommunicating with the cavity and the gas-outlet pathway 12112.

In accordance with embodiments of the present disclosure, the fixing component 12 and the reservoir 40 intercommunicate with each other via the first slot. Since the first slot is disposed at the bottom of the fixing component 12, that means the tobacco liquid stored in the reservoir 40 has to pass through the bottom of the fixing component 12 to enter into the fixing component 12. At this time, comparatively, the gas pathway 1211 formed in the fixing component 12 is disposed above the reservoir 40 and is separated from the reservoir 40.

Figure 5:
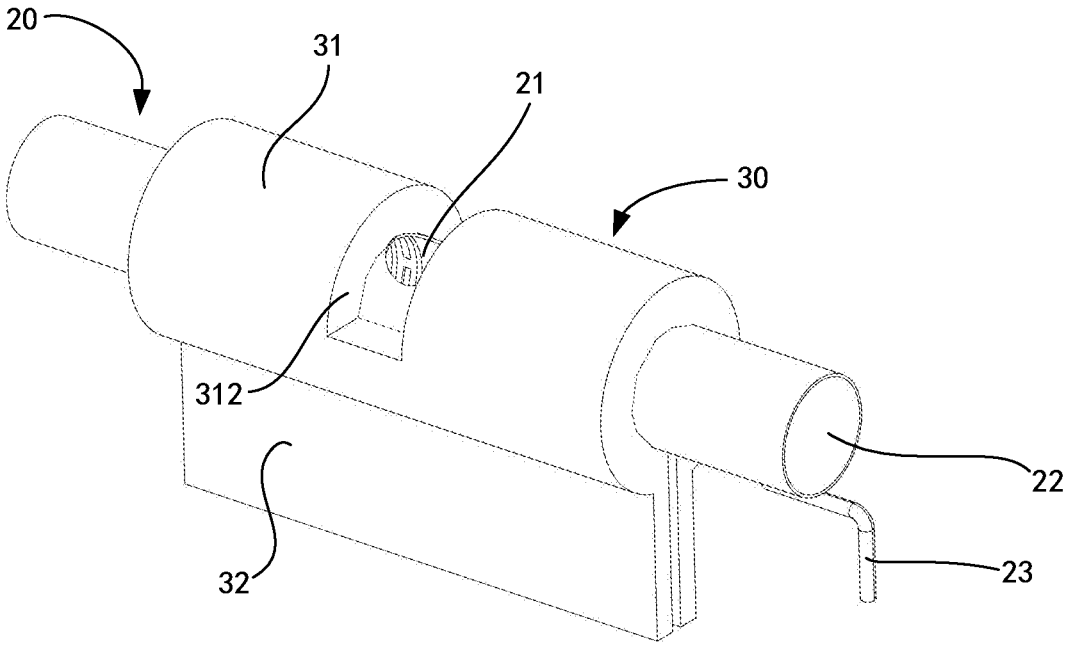
FIG. 5 is a assembled perspective view of the heater and the liquid conductor in accordance with the first embodiment of the present disclosure.

Referring to FIG. 1, FIG. 2 and FIG. 5, the heater 20 is a heating tube made by materials with comparatively good thermal-conductivity, which may be metallic heating tube or ceramic heating tube, configured for heating the tobacco liquid to generate an aerosol mist. The heating tube is a cylindrical body including a cylindrical wall and a first electrode 23.

The cylindrical wall encompasses an atomizing pathway 22, including a first through hole 21 and multiple openings 24.

The first through hole 21 passes through the cylindrical wall to intercommunicate with the atomizing pathway 22. The openings 24 are respectively disposed at two sides of the first through hole 21, surrounding the cylindrical wall. After the heating tube is supplied with electric power, the openings 24 allows the aerosol mist generated by atomizing tobacco liquid to flow through, the aerosol mist further flow into the atomizing pathway 22.

The first electrode 23 is posited at the cylindrical wall of one end of the heating tube, when the first electrode 23 is coupled with the power supply module, the heating tube starts to heat.

Of course, in some alternative embodiments, the first electrodes 23 may be respectively posited at two ends of the heating tube.

The heating tube is nested within the gas-inlet pathway 12111, as used herein, the outer dimension of the heating tube is consistent with the dimension of the gas-inlet pathway 12111 such that the heating tube is capable of tightly abutting the gas-inlet pathway 12111. Meanwhile, two ends of the heating tube respectively abutting against the first air inlet 1121 and the second air inlet 1122 means the atomizing pathway 22 intercommunicating with the first air inlet 1121 and the second air inlet 1122, allowing exterior air to flow through the first air inlet 1121 and the second air inlet 1122 then into the atomizing pathway 22 bearing the aerosol mist atomized by the heating tube.

Meanwhile, the first through hole 21 and the gas-outlet pathway 12112 are corresponding with the first slot, causing exterior air in the atomizing pathway 22 that bears the aerosol mist to flow into the gas-outlet pathway 12112 via the first through hole 21, eventually drawn by the user via the aerosol outlet 113. Furthermore, the first through hole 21 corresponding with the first slot causes the condensed or incomplete-atomized tobacco liquid to flow through the first through hole 21 and the first slot to deposit in the reservoir 40, which avoids redundant tobacco liquid to emerge in the gas pathway, therefore resolving the leakage problem of tobacco liquid.

Referring to FIG. 1, FIG. 2 and FIG. 5, the liquid conductor 30 may be oil absorbent cotton or non-woven fabrics, which includes a main portion 31 and an extending portion 32.

The main portion 31 has a semi-closed cylindrical structure with a cut to form a fourth receiving hole 311, an outer diameter thereof is inconsistent with the dimension of the cavity, an inner diameter thereof, that is the diameter of the fourth receiving hole 311 is inconsistent with the outer diameter of the heating tube.

The main portion 31 is further bored with the aerosol hole 312 that intercommunicates with the fourth receiving hole 311, and the aerosol hole 312 is posited correspondingly with the cut.

The extending portion 32 is extending downwards from the cut of the main portion 31, the number of the extending portions 32 is two, both parallel with each other and perpendicular to the main portion 31.

Preferably, the cut has a small size to avoid the tobacco liquid to flow into the gas pathway when inverting the electronic cigarette.

The main portion 31 surrounds a periphery of the heating tube nested within the fourth receiving hole 311. The main portion 31 abuts against the heating tube and the main portion 31 entirely covers openings 24 of the heating tube to permit the aerosol mist generated by the heating tub heating the tobacco liquid to enter in the atomizing pathway 22 via the openings 24. Meanwhile, the aerosol hole 312 opened on the main portion 31 and the cut both intercommunicate with the first through hole 21, that means the first through hole 21 on the heating tube is not covered by the main portion 31, thus exterior air bearing aerosol mist may flow through the first through hole 21 and the aerosol hole 312 to enter into the gas-outlet pathway 12112. Additionally, the condensed or incomplete-atomized tobacco liquid in the atomizing pathway 22 flowing through the first through hole 21 and the cut to be deposited in the reservoir 40, which effectively resolves the leakage problem of tobacco liquid.

When the main portion 31 surrounding the heating tube are nested within the gas-inlet pathway 12111, the heating tube is nested within the gas-inlet pathway 12111, the main portion 31 is properly received in the cavity and the aerosol hole 312 rightly faces the gas-outlet pathway 12112, the extending portion 32 is appropriately extending downwards to the space of the reservoir 40 formed by the base 13. The extending portion 32 absorbs tobacco liquid from the reservoir 40 at a lower position by capillary effect, the tobacco liquid is transferred to the main portion 31 for atomizing.

The liquid conductor 30 is not easy to get saturated by absorbing tobacco liquid from down to up, alleviating too much tobacco liquid filled up in the liquid conductor 30 causing gravity sedimentation. Meanwhile, since the first through hole 21, the cut and the first slot intercommunicate with the reservoir 40, and the first through hole 21, the cut and the first slot are deposited above the reservoir 40, even if the gravity sedimentation, the tobacco liquid in the liquid conductor 30 would settle to the reservoir 40 at a lower position, rather than coming into the gas pathway 1211 drawn by the user.

Referring to FIG. 1 and FIG. 2, the atomizer 1 further includes a first plug 51 and a second plug 52.

The first plug 51 is bored with a second through hole 511, the first plug 51 is assembled on an end of the heating tube from outside the fixing component 12, the end of the heating tube abuts against the first air inlet 1121 via the first plug 51. Accordingly, the first plug 51 is engaged with the first air inlet 1121, and the first air inlet 1121, the second through hole 511 and the atomizing pathway 22 intercommunicate with each other.

The second plug 52 is bored with a third through hole 521, the second plug 52 is assembled on an opposite end of the heating tube from outside the fixing component 12, the opposite end of the heating tube abuts against the second air inlet 1122 via the second plug 52. Accordingly, the second plug 52 is engaged with the second air inlet 1122, and the second air inlet 1122, the third through hole 521 and the atomizing pathway 22 intercommunicate with each other.

The first plug 51 and the second plug 52 are capable of preventing the tobacco liquid to flow into the first air inlet 1121, the second air inlet 1122 and the atomizing pathway 22.

The atomizer 1 further includes a leading wire 60 that is electrically connected with the first electrode 23, and the first electrode 23 is coupled with the power supply module for supplying power to the power supply module.

Understandable, in some embodiments, when assembling the atomizer 1, firstly wrapping the liquid conductor 30 around a periphery of the heating tube, making the heating tube received in the fourth receiving hole 311 of the main portion 31 of the liquid conductor 30, of which the aerosol hole 312 and the cut are corresponding with the first through hole 21; secondly, assembling the assembled heating tube and liquid conductor 30 into the gas-inlet pathway 12111 of the fixing component 121 causing that the main portion 31 is appropriately received in the cavity, the aerosol hole 312 is corresponding with the gas-outlet pathway 12112 and the extending portion 32 is disposed at the first groove 1212; thirdly, assembling the clamping cover 122 with the gas-inlet pathway 12111 to clamp with the fixing component 121; via the protrusion 1221 of the clamping cover 122, the heating tube and the main portion 31 of the liquid conductor 31 are clamped into the gas-inlet pathway 12111, meanwhile, the second groove 1222 and the first groove 1212 form the first slot allowing the extending portion 32 to extend through the first slot; at last, assembling the first plug 51 onto one end of the heating tube from outside the fixing component 12 and assembling the second plug 52 onto an opposite end of the heating tube from outside the fixing component 12; clamping the flattened body 121 of the fixing component 12 into the clamping slot 115 of the receiving chamber 111 such that the first plug 51 abuts against the first air inlet 1121 and the second plug 52 abuts against the second air inlet 1122. In this case, the first air inlet 1121, the second through hole 511, the atomizing pathway 22 and the third through hole 521 respectively intercommunicate with the second air inlet 1122. Ultimately, coupling the leading wire 60 with the first electrode 23 and guiding the leading wire 60 to a bottom of the shell 11 and riveting the base 13 with the receiving chamber 111 via gasket rings, in this case, the shell 11, the fixing component 12 and the base 13 together define the reservoir 40. The gas pathway 1211, the heating tube and the liquid conductor 30 are all disposed above the reservoir 40. The extending portion 32 of the liquid conductor 30 extends into the reservoir 40, separating the gas pathway 1211 from the reservoir 40.

Additional aspects and advantages of the present disclosure will be: comparing with the prior art, the present disclosure relates to an atomizer and an electronic cigarette having the same. The atomizer includes: an atomizing body, a heater and a liquid conductor. As used herein, the atomizing body of the atomizer has a reservoir for storing tobacco liquid, a gas pathway, an air inlet and an aerosol outlet. The liquid conductor includes a main portion and an extending portion, inside of the heater forms a hollow atomizing pathway; the air inlet and the aerosol outlet respectively intercommunicate with the gas pathway that is formed above the reservoir and separated from the reservoir; the heater is nested within the gas pathway, the atomizing pathway intercommunicates with the gas pathway, the main portion of the liquid conductor surrounds the heater exclusive of the extending portion extending into the reservoir; the extending portion of the liquid conductor absorbs tobacco liquid from the reservoir at a lower position to the heater nested within the gas pathway at an upper position, making the liquid conductor not easy to get saturated, alleviating liquid deposition in the liquid conductor under gravity force. Furthermore, since the reservoir is disposed below the gas pathway, the heater and the liquid conductor, even if the liquid deposition is happened, the tobacco liquid would settle into the reservoir rather than coming into the gas pathway, which effectively resolves the leakage problem of tobacco liquid to improve user experience.

Embodiment 2

Figure 6:
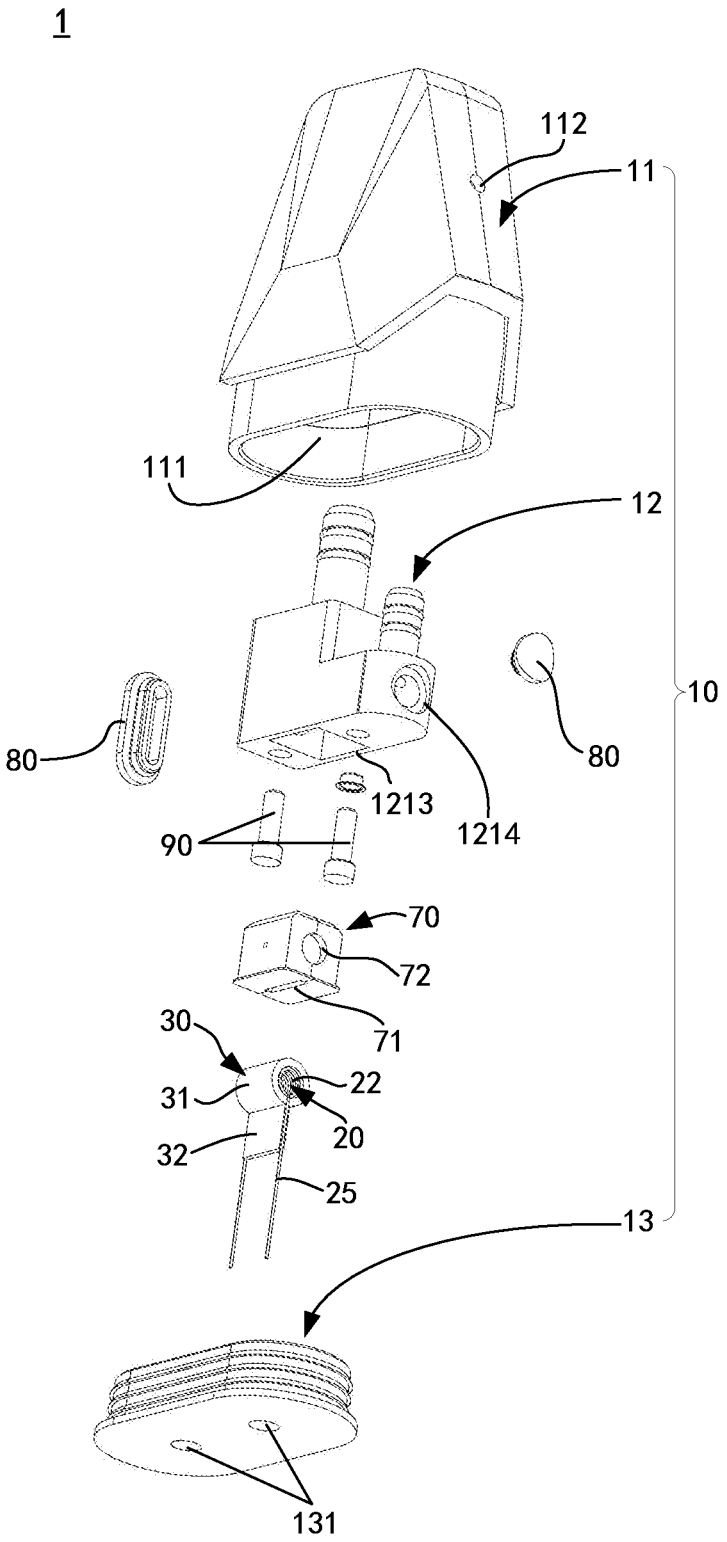
FIG. 6 is an exploded view of the atomizer in accordance with a second embodiment of the present disclosure.
Figure 7:
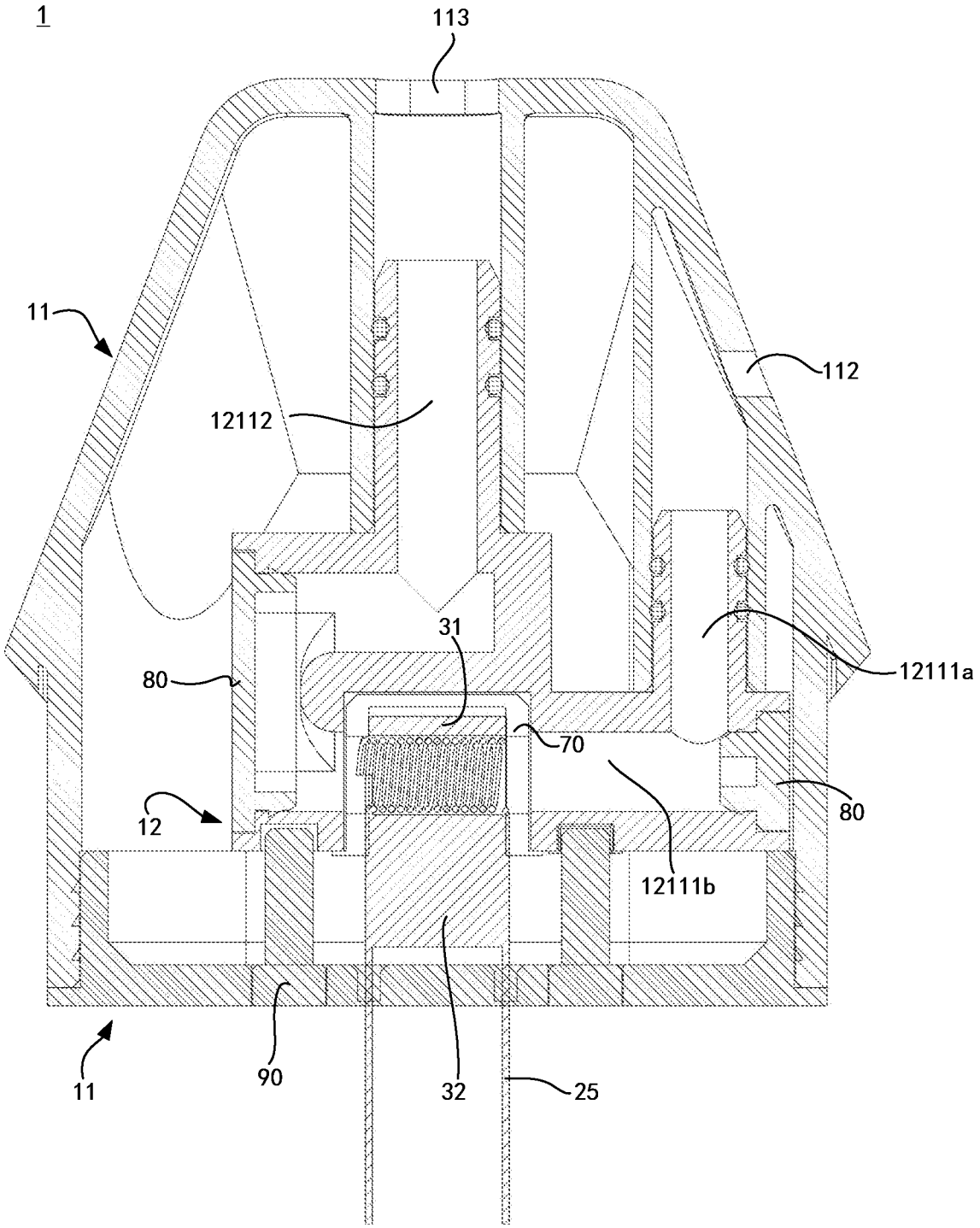
FIG. 7 is a cross-sectional view of the atomizer in accordance with the second embodiment of the present disclosure.

Referring to FIG. 6 and FIG. 7, which illustrate an atomizer in accordance with an embodiment of the present disclosure. The atomizer 1 includes: an atomizing body 10, a heater 20, a liquid conductor 30 and a clamping component 70. The liquid conductor 30 surrounding the heater 20 is received in the clamping component 70 and later on is received in the atomizing body 10 via the clamping component 70.

More specifically, the atomizing body 10 includes a shell 11, a fixing component 12 and a base 13.

Figure 8:
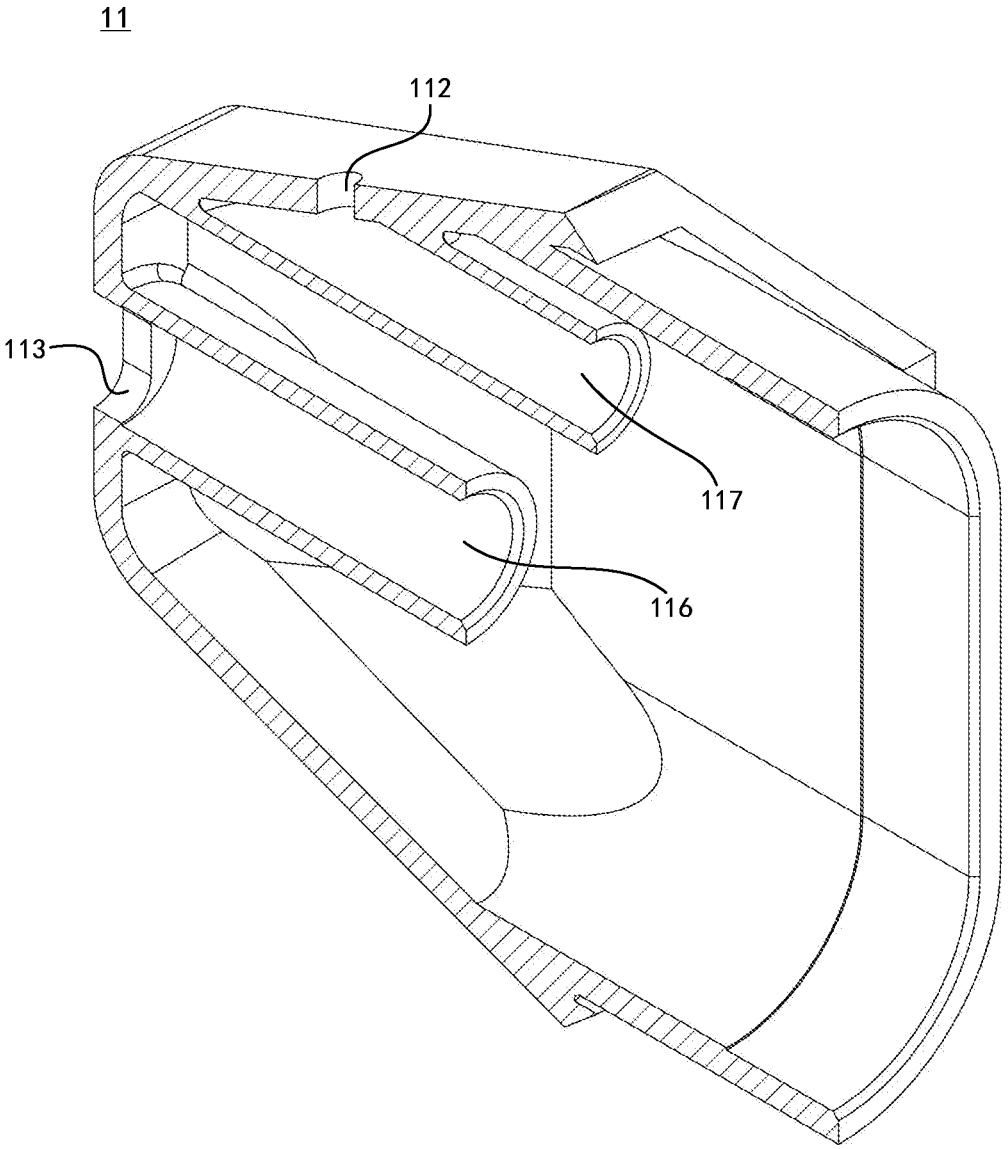
FIG. 8 is an exploded perspective view of the shell of the atomizer in accordance with the second embodiment of the present disclosure.

Referring to FIGS. 6-8, the shell 11 has a receiving chamber 111 formed therein, the receiving chamber 111 is encompassed by a side wall (not shown) and a top wall (not shown). The side wall of the shell 11 is bored with an air inlet 112. The air inlet 112 is perpendicular to the receiving chamber 111 and the air inlet 112 intercommunicates with the receiving chamber 111. The top wall of the shell 11 is bored with an aerosol outlet 113. The aerosol outlet 113 is perpendicular to the top wall and the aerosol outlet 113 intercommunicates with the receiving chamber 111. In this case, exterior air may enter into the atomizer 1 from the side wall and be drawn out from the top of the atomizer 1, making the aerosol mist to flow more smoothly.

As used herein, the number of the air inlets 112 and the number of the air outlets 113 are both one, the air inlet 112 is disposed on any one of the side walls of the shell 11, the aerosol outlet 113 is disposed at a middle of the top wall of the shell 11. Of course, in some alternative embodiment, the aerosol outlet 113 may be disposed on anywhere of top wall of the shell 11.

A third receiving hole 117 extends downwards from an inside of the side wall bored with the air inlet 112; the third receiving hole 117 intercommunicates with the air inlet 112.

A second receiving hole 116 extends downwards from an inside of the top wall. The second receiving hole 116 is correspondingly in communication with the aerosol outlet 113.

The second receiving hole 116 and the third receiving hole 117 are parallel with each other.

The base 13 is received in the receiving chamber 111, a dimension thereof is inconsistent with a dimension of an inner wall of the receiving chamber 111, making the base 13 available of being riveted with the receiving chamber 111 via the gasket rings.

An upper surface of the base 13 can also be recessed to form a space for receiving.

Additionally, the base 13 is opened with an injection hole 131 that intercommunicates with the reservoir 40. Preferably, the number of the injection holes 131 is two. The user may replenish the tobacco liquid to the reservoir 40 via the injection holes 131.

The fixing component 12 is received in the receiving chamber 11, between the shell 11 and the base 13. And the fixing component 12 is fixedly connected with the shell 11 via the second receiving hole 116 and the third receiving hole 117. Moreover, the shell 11, the fixing component 12 and the base 13 together define a reservoir 40. The reservoir 40 is configured for storing tobacco liquid, and the tobacco liquid stored in the reservoir 40 may settle to the space that is formed by the recessed upper surface of the base 13.

Figure 9:
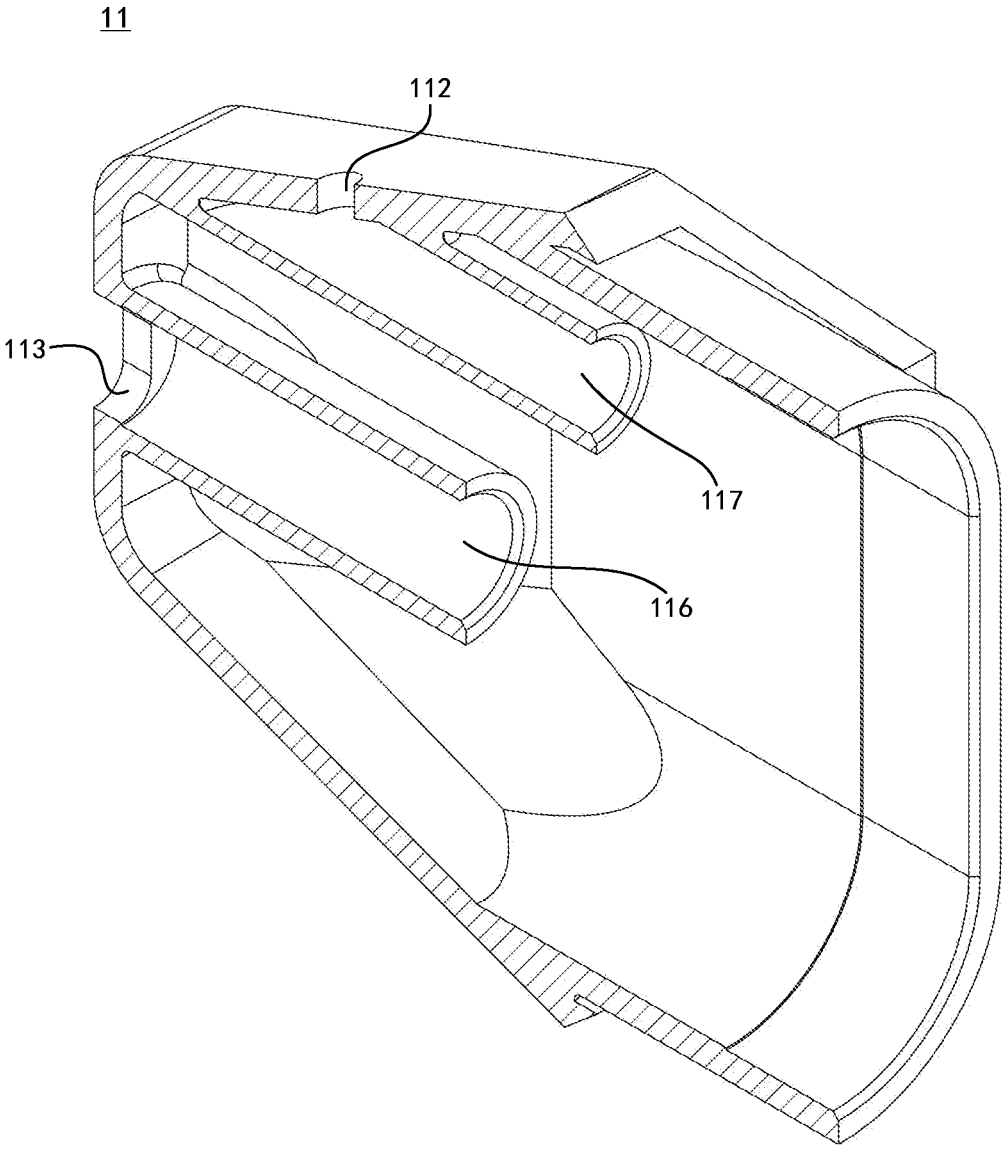
FIG. 9 is a cross-sectional view of the fixing component of the atomizer in accordance with the second embodiment of the present disclosure.

More specifically, referring to FIG. 6, FIG. 7 and FIG. 9, the fixing component 12 is bored with a gas pathway 1211, a second slot 1213 and an opening 1214.

The gas pathway 1211 includes a gas-inlet pathway 12111 and a gas-outlet pathway 12112. As used herein, the gas-inlet pathway 12111 includes a first gas-inlet pathway 12111*a* and a second gas-inlet pathway 12111*b*, the second gas-inlet pathway 12111*b* is extending along a direction of the transverse axis. The first gas-inlet pathway 12111*a* and a second gas-inlet pathway 12111*b* are extending along a direction of the longitudinal axis. Meanwhile, the second gas-inlet pathway 12111*b* is perpendicular to the first gas-inlet pathway 12111*a* and the gas-outlet pathway 12112. The first gas-inlet pathway 12111*a*, the second gas-inlet pathway 12111*b* and the gas-outlet pathway 12112 together form a U-shaped gas pathway.

A part of the fixing component 12 that is bored with the first gas-inlet pathway 12111*a* is received in the third receiving hole 117 of the shell 11, riveted with the third receiving hole 117, thus making the first gas-inlet pathway 12111*a* to correspondingly intercommunicate with the air inlet 112.

A part of the fixing component 12 that is bored with the gas-outlet pathway 12112 is received in the second receiving hole 116 of the shell 11, riveted with the second receiving hole 116, thus making the gas-outlet pathway 12112 to correspondingly intercommunicate with the aerosol outlet 113.

In this case, one end of the second gas-inlet pathway 12111*b* nearing to the first gas-inlet pathway 12111*a* abuts against an inner wall of the shell 11.

The slot 1213 is set at a bottom of the second gas-inlet pathway 12111*b*, intercommunicating with the second gas-inlet pathway 12111*b* and not corresponding with the first gas-inlet pathway 12111*a* and the gas pathway 12112.

Meanwhile, the second gas-inlet pathway 12111*b* is provided with a clamping cavity (not shown) for receiving the clamping device. The clamping cavity is corresponding with the second slot 1213, and the clamping cavity is consistent with the second slot 1213 in a cross sectional area.

The openings 1214 are respectively disposed at two ends of the second gas-inlet pathway 12111*b*, as an aid for users to clean the gas pathway 1211.

In the embodiments of the present disclosure, the fixing component 12 intercommunicates with the reservoir 40 via the second slot 1213. The second slot 1213 is located at a bottom of the fixing component 12, which means the tobacco liquid stored in the reservoir 40 can only flow into the fixing component 12 via the bottom of the fixing component 12. Relatively, the gas pathway 1211 in the fixing component 12 is disposed above the reservoir 40 and separated from the reservoir 40.

Referring to FIG. 6 and FIG. 7, the clamping component 70 has a rectangular shape, made by detachably connecting a first shell (not shown) and a second shell (not shown), which is convenient to fixedly assemble the liquid conductor 30 and the heater 20. The clamping component 70 has the cavity (not shown) for receiving the liquid conductor, and two opposite side walls of the clamping component 70 both are bored with the fourth through holes 72 opposite with each other, and the fourth through holes 72 intercommunicate with the cavity. A bottom of the clamping component 70 has a third slot 71 intercommunicating with the cavity.

The dimension of the clamping component 70 is consistent with that of the second slot 1213. The clamping component 70 passing through the second slot 1213 to be received in the clamping cavity that is received in the second gas-inlet pathway 12111*b*, riveted with the fixing component 12.

When the clamping component 70 is received in the second gas-inlet pathway 12111*b*, the fourth through hole 72 intercommunicates with the second gas-inlet pathway 121111*b*, and the third slot 71 is located at a bottom of the second gas-inlet pathway 12111*b*.

Referring to FIG. 6 and FIG. 7, the heater 20 is a heating coil made by tightly winding sets of singular or two or multiple metallic heating wires. In the embodiment, the heating coil is made by winding a singular heating wire to a spiral shape, with an equivalent interval. Preferably, the metallic heating wire is made of nickel, iron-nickel or iron-chrome-aluminium alloys etc.

The heating wire is manufactured as the spiral shape, inside of the heating wire is the atomizing pathway 22. Two ends thereof are respectively adopted as the second electrodes 25.

By relying on the second electrode 25 coupled with the power supply module, the heating coil is electrified to heat the tobacco liquid for atomization.

The heating coil is received in the cavity of the clamping component 70, intercommunicating with the fourth through hole 72 and the second gas-inlet pathway 12111*b* correspondingly, permitting exterior air to flow into the first gas-inlet pathway 12111*a* via the air inlet 112, later on the exterior air passing through the first gas-inlet pathway 12111*a* to the second gas-inlet pathway 12111*b*, passing through the atomizing pathway 22 formed by the heating coil while bearing the aerosol mist to the gas-outlet pathway 12112, further being drawn by the user from the aerosol outlet 113.

Meanwhile, the heating coil is corresponding with the third slot 71, enabling condensed or incomplete-atomized tobacco liquid successively passing through the seams among the heating coil and the third slot 71 to settle to the reservoir 40. Thus redundant tobacco liquid is avoided to emerge in the atomizing pathway 22 so that the exterior air bears redundant tobacco liquid to the gas-outlet pathway 12112, drawn by the user, which effectively resolves the leakage problem of tobacco liquid.

Referring to FIG. 6 and FIG. 7, the liquid conductor 30 is an oil absorbent cotton or non-woven fabrics, including: a main portion 31 and an extending portion 32.

The main portion 31 is a cylindrical tube, having a fifth receiving hole (not shown) formed therein, an outer diameter of the fifth receiving hole is consistent with the inner diameter of the cavity, an inner diameter of the fifth receiving hole is consistent with the outer diameter of the heating coil.

The extending portion 32 is extending downwards from the main portion 31, the extending portion 32 is perpendicular to the main portion 31.

The main portion 31 surrounding a periphery of the heating coil that is nested within the fifth receiving hole of the main portion 31, the main portion 31 abuts against the heating coil, and the heating coil is totally received in the main portion 31 such that the tobacco liquid may be guided to the heating coil for heating via the liquid conductor 30. Meanwhile, the second electrodes 25 of the heating coil are disposed at two opposite sides of the extending portion 32.

When the main portion 31 surrounding the heating coil is received in the clamping component 70, the main portion 31 is properly received in the cavity. The extending portion 32 along with the second electrode 25 extends downwards to the space formed by the recessed base 13 passing through the third slot 71. As used herein, the space is inside the reservoir 40. The extending portion 32 absorbs the tobacco liquid from the reservoir 40 at a lower position by capillary action, guiding the tobacco liquid to the main portion 31 for the heating coil to heat and atomize. The liquid conductor 30 absorbing tobacco liquid from down to up by capillary action is not easy to get saturated, alleviating a phenomena of gravity sedimentation on the liquid conductor 30 containing too much tobacco liquid. Additionally, since the liquid conductor 30, the heater 20, the gas pathway 1211 and the third slot 71 are disposed above the reservoir 40, even if the liquid conductor 30 has gravity sedimentation, the tobacco liquid would settle to the reservoir 40, rather than flowing to the gas pathway 1211 drawn by the user.

Referring to FIG. 6 and FIG. 7, the atomizer 1 further includes a third plug 80 that is detachably engaged with the opening 1214. The user may remove the plug 80 to clean the gas pathway 1211 via the opening 1214.

The third plug 80 is configured to seal up the opening 1214, avoiding the tobacco liquid in the reservoir 40 to flow into the gas pathway 1211.

The atomizer 1 further includes an injection plug 90 that is detachably engaged in the injection hole 131. The user may dismantle the injection plug 90 to inject tobacco liquid to the reservoir 40.

Understandable, in the embodiments of the present disclosure, when assembling the atomizer 1, firstly surrounding the liquid conductor 30 around a periphery of the heating coil makes that the heating coil is received in the fifth receiving hole of the main portion 31. In this case, the heating coil is nested within the main portion 31 and the second electrodes 25 are disposed at two sides of the extending portion 32. Secondly, disposing the assembled liquid conductor 30 and heating coil together to the cavity of the clamping component 70 makes that the atomizing pathway 22 of the heating coil is in communication with the fourth through hole 72. The extending portion 32 and the second electrode 25 are passing through the third slot 71. Next, disposing the clamping component 70 in the clamping cavity located in the second gas-inlet pathway 12111*b* by passing through the second slot 1213 permits that the atomizing pathway 22, the fourth through hole 72 and the second gas-inlet pathway 12111*b* intercommunicate with each other. Then, sealing the third plug 80 into the opening 1214 of the fixing component 12 and receiving the partial fixing component 12 with the first gas-inlet pathway 12111*a* formed therein into the third receiving hole 117 of the shell 11 to rivet the third receiving hole 117, thus makes that the first gas-inlet pathway 12111*a* is in communication with the air inlet 122. And sealing the partial fixing component 12 with the gas-outlet pathway 12112 formed therein into the second receiving hole 116 of the shell 11 to rivet the second receiving hole 116, makes that the gas-outlet pathway 12112 intercommunicates with the aerosol outlet 113 and an end of the second gas-inlet pathway 12111*b* near to the first gas-inlet pathway 12111*a* abuts against an inner wall of the shell 11 via the third plug 80. Finally, riveting the base 13 with an inner wall of the receiving chamber 111 makes that the shell 11, the fixing component 12 and the base 13 together form the reservoir 40. In this case, the gas pathway 1211, the heating coil and the liquid conductor 30 are all disposed above the reservoir 40 and the extending portion 32 of the liquid conductor 30 extends into the reservoir 40 such that the gas pathway 1211 is separated from the reservoir 40.

Additional aspects and advantages of the present disclosure will be: comparing with the prior art, the present disclosure relates to an atomizer and an electronic cigarette having the same. The atomizer includes: an atomizing body, a heater and a liquid conductor. As used herein, the atomizing body of the atomizer has a reservoir for storing tobacco liquid, a gas pathway, an air inlet and an aerosol outlet. The liquid conductor includes a main portion and an extending portion, inside of the heater forms a hollow atomizing pathway; the air inlet and the aerosol outlet respectively intercommunicate with the gas pathway that is formed above the reservoir and separated from the reservoir; the heater is nested within the gas pathway, the atomizing pathway intercommunicates with the gas pathway, the main portion of the liquid conductor surrounds the heater exclusive of the extending portion extending into the reservoir; the extending portion of the liquid conductor absorbs tobacco liquid from the reservoir at a lower position to the heater nested within the gas pathway at an upper position, making the liquid conductor not easy to get saturated, alleviating liquid deposition in the liquid conductor under gravity force. Furthermore, since the reservoir is disposed below the gas pathway, the heater and the liquid conductor, even if the liquid deposition is happened, the tobacco liquid would settle into the reservoir rather than coming into the gas pathway, which effectively resolves the leakage problem of tobacco liquid to improve user experience.

Embodiment 3

An electronic cigarette is provided by the present disclosure, the electronic cigarette (not shown) includes a power supply module (not shown) and the aforementioned atomizer (not shown), the power supply module is detachably connected with the atomizer 1.

More specifically, the power supply module is coupled with the first electrode 23 or the second electrode 25 to supply power to the heater 20 heating the tobacco liquid for atomization.

Embodiment 4

Figure 10:
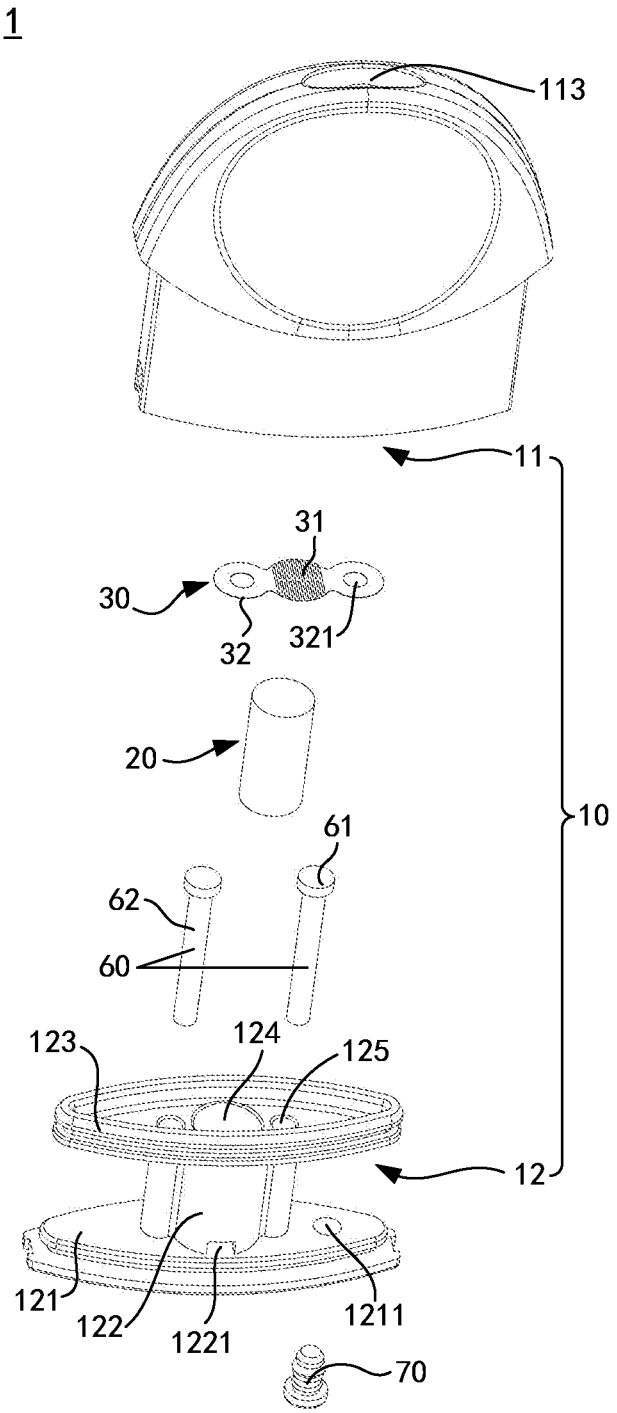
FIG. 10 is an exploded view of the atomizer in accordance with an embodiment of the present disclosure.
Figure 11:
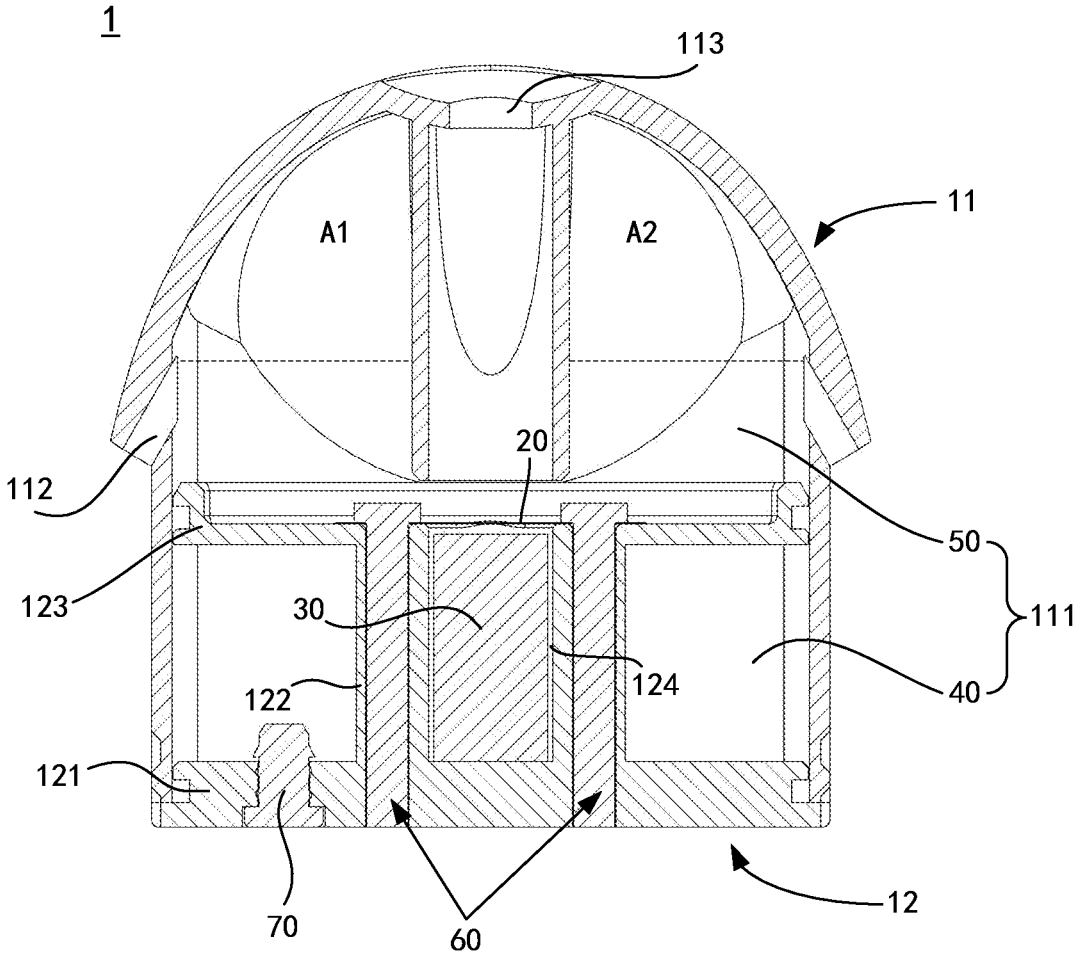
FIG. 11 is a cross-sectional view of the atomizer in accordance with an embodiment of the present disclosure.

Referring to FIG. 10 and FIG. 11, which illustrate an atomizer in accordance with fourth embodiment of the present disclosure. The atomizer 1 includes: an atomizing body 10, a liquid conductor 20 and a heater 30. The liquid conductor 20 and the heater 30 both are disposed in the atomizing body 10, and the heater 30 is disposed above the liquid conductor 20.

More specifically, the atomizing body 10 includes: a shell 11 and a base 12.

Figure 12:
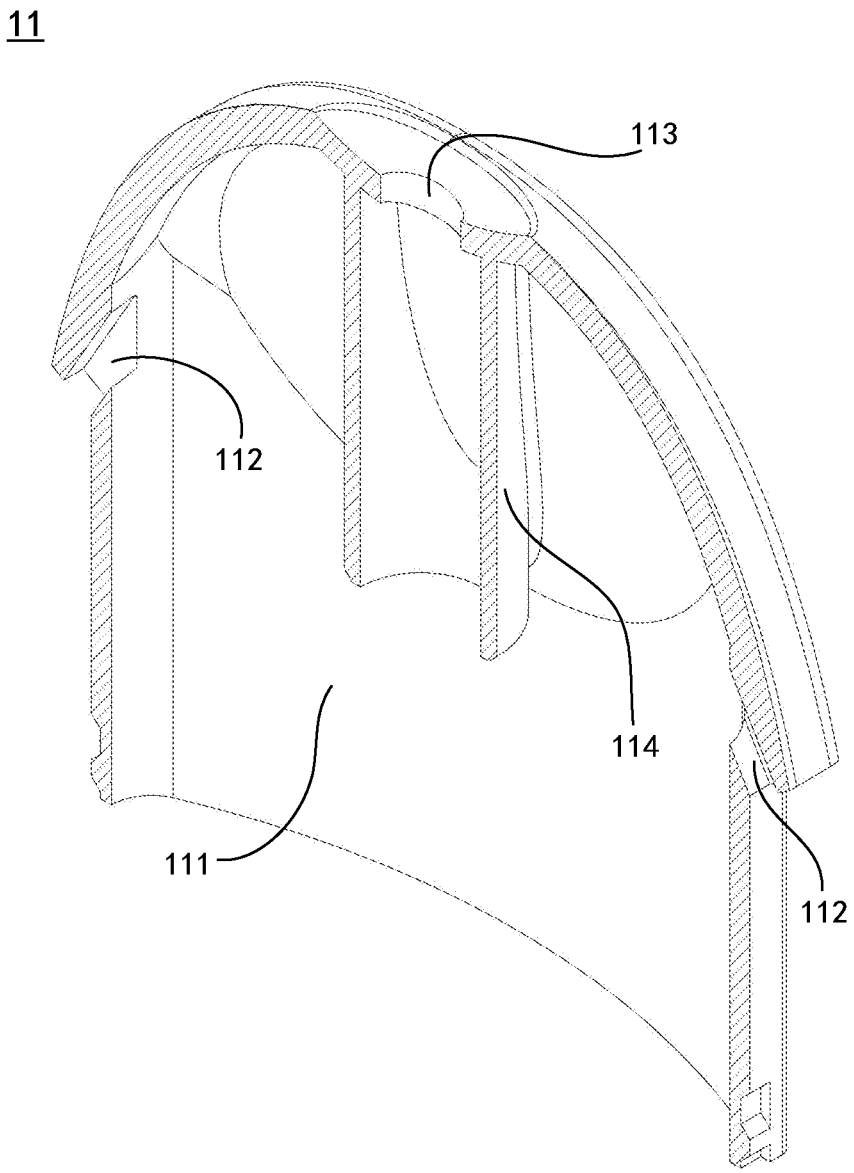
FIG. 12 is a perspective view of the shell of the atomizer in accordance with an embodiment of the present disclosure.

Referring to FIGS. 10-12, the shell 11 has a receiving chamber 111 formed therein, the receiving chamber 11 is encompassed by a side wall (not shown) and a top wall (not shown). As used herein, the side wall is rectangular-shaped, the top wall is arc-shaped.

A junction of the side wall and the top wall of the shell 11 is provided with an air inlet 112 that is inclined to the side wall at a certain angle less than 90 degree. And the air inlet 112 is in communication with the receiving chamber 111, allowing exterior air to flow into the receiving chamber 111 via the air inlet 112, to settle in areas of A1 and A2 as shown in FIG. 11.

The top wall of the shell 11 is provided with an aerosol outlet 113 that is perpendicular to the top wall, and the aerosol outlet 113 is in communication with the receiving chamber 111. In this case, the exterior air may flow in the atomizer 1 from side thereof with an inclined angle, and flow out from top of the atomizer 1, which may ensure gas flow to be more smooth in the electronic cigarette.

Preferably, the number of the air inlets 112 is two, symmetrically disposed at two opposite side walls, which may ensure exterior air to flow in the receiving chamber 111 more evenly. The number of the aerosol outlet is one, disposed at a middle of the top wall.

Furthermore, a gas-outlet pathway 114 is extending downwards from an inner surface of the top wall, the gas-outlet pathway 114 is perpendicular to the top wall and intercommunicates with the aerosol outlet 113. Exterior air flow into the receiving chamber 111 via the air inlet 112 may be expelled out of the aerosol outlet 113 through the gas-outlet pathway 114.

Furthermore, a bottom opening of the gas-outlet pathway 114 is lower than the air inlet 112 along a direction of a longitudinal axis of the electronic cigarette, that is, a length of the gas-outlet pathway 114 exceeds a position of the air inlet 112 along the direction of the longitudinal axis. In this case, exterior air from the air inlet 112 needs to settle down to the opening of the gas-outlet pathway 114, then expelled out of the aerosol outlet 113 through the gas-outlet pathway 114.

Figure 13:
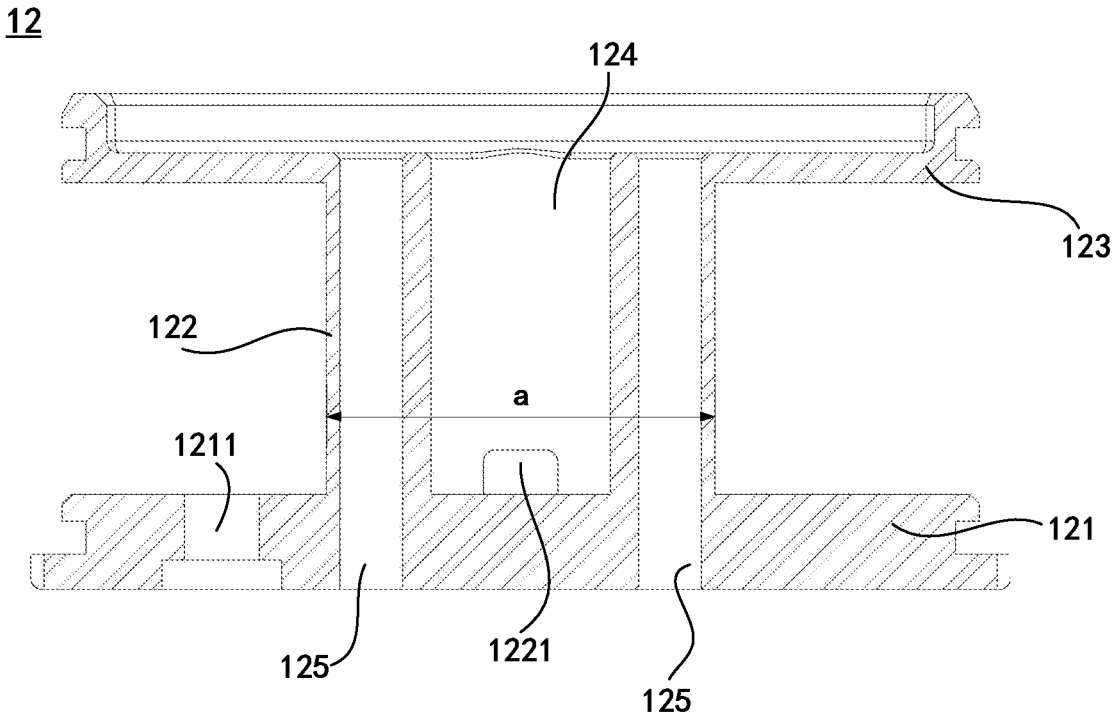
FIG. 13 is a perspective view of the base of the atomizer in accordance with an embodiment of the present disclosure.

Referring to FIG. 10, FIG. 11 and FIG. 13, the base 12 includes a first base 121, an extending portion 122, a second base 123, a first receiving hole 124 and a second receiving hole 125.

As used herein, the first base 121, the extending portion 122 and the second base 123 are formed as one object. The extending portion 122 is deposed between the first base 121 and the second base 123, perpendicular to the first base 121 and to second base 123. That is, the first base 121, the extending portion 122 and the second base 123 together have a cross-section of H shape.

Furthermore, the first base 121 is equal to the second base 123 in length, and a width of the extending portion 122 is less than the length of the first base 121 and the second base 123. In other words, along a direction of a transverse axis, a dimension of the extending portion 122 is less than a dimension of the first base 121 and the second base 123, as shown in FIG. 13.

The first base 121 has an injection hole 1211 formed thereon, the injection hole 1211 passes through the first base 121. In the embodiment, the number of the injection hole 1211 is one that is provided on areas of the first base 121 exclusive of the area connecting with the extending portion 122. In some alternative embodiment, the number of the injection holes 1211 is multiple.

A side wall of the extending portion 122 is bored with a liquid conductive hole 1221 that is located at an junction of the first base 121 and the extending portion 122. In the embodiment, the number of the liquid conductive holes 1221 is two, symmetrically disposed on the side wall of the extending portion 122.

An upper surface of the second base 123 that does not contact the extending portion 122, is opened with a groove (not shown) for receiving the heater 30.

Furthermore, the first receiving hole 124 passing through the extending portion 122 and the second base 123, to intercommunicate with the groove and the liquid conductive hole 1221. In the embodiment, the number of the first receiving hole 124 is one, and the first receiving hole 124 is disposed at a middle of the extending portion 122.

The second receiving hole 125 passing through the first base 121, the extending portion 122 and the second base 123 to intercommunicate with the groove. In the embodiment, there are two second receiving holes 125, symmetrically disposed at two sides of the first receiving hole 124. As used herein, the second receiving hole 125 extends along a direction of the longitudinal axis that is perpendicular to the extending of the liquid conductive hole 1221 along a direction of the transverse axis.

The base 12 is received in the receiving chamber 111 to be sealed up with the inner wall of the receiving chamber 111.

More specifically, the dimensions of the first base 121 and the second base 123 are respectively equal to the dimension of the inner wall of the receiving chamber 111, the dimension of the extending portion 122 is less than the dimension of the inner wall of the receiving chamber 111. When the base 12 is received in the receiving chamber 111, the first base 121 and the second base 123 are riveted with the inner wall of the receiving chamber 111. In this case, the groove of the second base 123 is between the gas-outlet pathway 114 and the second base 123. A gas pathway 50 is formed between the second base 123 and the shell 11, intercommunicating with the air inlet 112 and the aerosol outlet 113, and the gas pathway 50 is configured for guiding the tobacco liquid to the user's mouth to be drawn by the user. The second base 123, the extending portion 122, the first base 121 and the shell 11 encompass an annular space to form an reservoir 40 below the gas pathway 50 which is configured for storing tobacco liquid. In this case, the reservoir 40 is below the gas pathway 50 and separated from the gas pathway 50. The first receiving hole 124 is corresponding with the gas-outlet pathway 114 and the aerosol outlet 113. And the first receiving hole 124 is in communication with the reservoir 40 via the liquid conductive hole 1221, permitting the tobacco liquid in the reservoir 40 to flow into the first receiving hole 124 via the liquid conductive hole 1221. By means of the liquid conductive hole 1221 disposed at a bottom of the extending portion 122, all the tobacco liquid in the reservoir 40 may flow into the first receiving hole 124 via the liquid conductive hole 1221, alleviating waste of the tobacco liquid. The injection hole 1211 is in communication with the reservoir 40, allowing the user to replenish the tobacco liquid to the reservoir 40 via the injection hole 1211.

Of course, in some embodiments, the base 12 is sealed up with an inner wall of the receiving chamber 111 via a gasket ring.

Referring to FIG. 10 and FIG. 11, the liquid conductor 20 is an oil absorbent cotton or non-woven fabrics with comparably good storage ability of tobacco liquid. The liquid conductor 20 is cylindrical-shaped, a diameter thereof is similar/equal to that of the first receiving hoe 124.

The liquid conductor 20 is received in the first receiving hole 124. And the inner wall of the first receiving hole 124 abuts against the liquid conductive hole 1221, that is, the gas pathway 50 is separated from the reservoir 40, by relying on the liquid conductor 20, the tobacco liquid in the reservoir 40 can only be absorbed by the liquid conductor 20 under capillary action, the tobacco liquid cannot nevertheless enter into the gas pathway 50. And the liquid conductor 20 absorbs tobacco liquid from the annular reservoir 40 that is nearly at same position along the direction of the longitudinal axis. Therefore, the liquid conductor 20 is not easy to get saturated because of the capillary action, and a phenomenon of gravity sedimentation due to too much tobacco liquid in the liquid conductor 20 is alleviated.

Furthermore, when the liquid conductor 20 is received in the first receiving hole 124, it is surrounded by the reservoir 40 and extending upwardly to the gas pathway 50. In this case, the tobacco liquid absorbed by the liquid conductor 20 would settle to the reservoir 40 only under gravity sedimentation, rather than flowing into the gas pathway 50 to cause leakage of tobacco liquid, which may effectively resolve the leakage problem of the tobacco liquid, so as to improve the user experience.

Furthermore, when the first receiving hole 124 is received in the liquid conductor 20, due to fluffiness of the first receiving hole 124, it is partly received in the groove formed at the upper surface of the second base 123.

Figure 14:
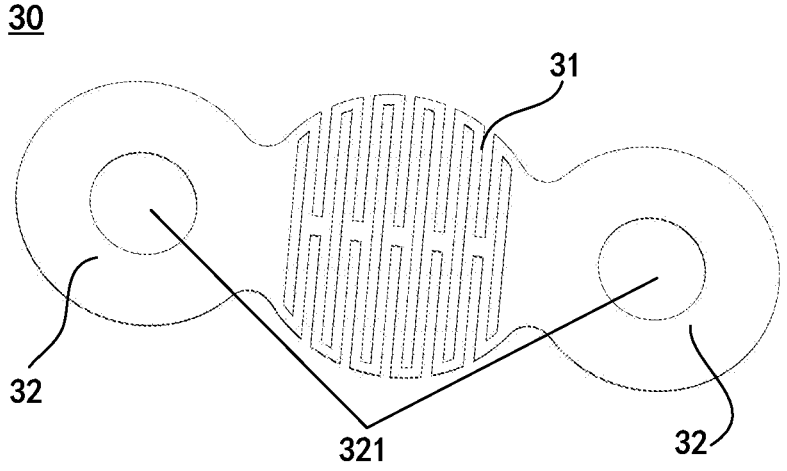
FIG. 14 is an illustrated view of the heater of the atomizer in accordance with an embodiment of the present disclosure.

Referring to FIG. 10, FIG. 11 and FIG. 14, the heater 30 is a disk-shaped heating piece made of good thermal-conductivity materials, that is, a metallic heating piece or a ceramic heating piece. The heating piece includes a heating part 31 and a fixing part 32.

The heating part 31 is disk-shaped that is bored with multiple heating slots (not shown). The multiple heating slots pierce through the heating part 31, arrayed in sequence.

The fixing part 32 is disk-shaped. A middle of the fixing part 32 is bored with a fixing hole 321. The fixing hole 321 pierces through the fixing part 32, the number thereof is one. Preferably, the number of the fixing parts 32 is two, symmetrically disposed at two sides of the heating part 31, fixedly connected with the heating part 31 at the same horizontal level.

The heating piece is disposed in the middle of the gas pathway 50 to contact the liquid conductor 20, permitting the liquid conductor 20 to guide the tobacco liquid to the heating coil for heating. More specifically, the heating piece is received in the groove, between the gas-outlet pathway 114 and the second base 123. In this case, the heating part 31 of the heating piece is corresponding with the liquid conductor 20 and the gas-outlet pathway 114, to contact the liquid conductor 20. The fixing hole 321 of the heating piece is corresponding to the second receiving hole 125.

Referring to FIG. 10 and FIG. 11 again, the atomizer 1 further includes an electrode mast 60, the electrode mast 60 is made of good electricity-conductivity materials. The electrode mast 60 includes a lid 61 and a protrusion 62. The lid 61 is a cylindrical object, a diameter of lid 61 is larger than a diameter of the fixing hole 321.

The protrusion 62 is a cylindrical object extending downwardly from a bottom of the lid, a diameter of the protrusion 62 is less than the diameter of the lid 61 and equal with the diameter of the second receiving hole 125. The length of the protrusion 62 is equal with the length of the second receiving hole 125.

Preferably, the number of the electrode masts 60 is two.

The electrode mast 60 passing through the second receiving hole 125 and the fixing hole 321 of the heating piece. By using the lid 61, the fixing part 32 of the heating piece is fixed to the second base 123. The protrusion 62 is received in the second receiving hole 125 to rivet with the second receiving hole 125. The bottom of the protrusion 62 and the bottom of the first base 121 are at the same horizontal level such that by relying on the protrusion 62 being electrically connecting with the power supply module supplies power, the power supply module can supply power to the heating piece.

When the electrode mast 60 fixes the heating piece to the second base 123, the heating piece 123 is disposed above the liquid conductor 20 to compact the loosed liquid conductor 20 and abut against the liquid conductor 20, so that the heating piece may heat the tobacco liquid in the liquid conductor 20.

The atomizer 1 further includes an injection plug 70.

A diameter of the injection plug 70 is equal with the diameter of the injection hole 1211, the injection plug 70 may be detachably engaged in the injection hole 1211 to seal up the injection hole 1211, so that the user may dismantle the injection plug 70 to replenish tobacco liquid to the reservoir 40.

Understandable, in some embodiments, the liquid conductor 20 absorbs tobacco liquid flowing from the reservoir 40 through the liquid conductive hole 1221 at the bottom of the liquid conductor 20, further guiding the tobacco liquid to the upper heating piece for the heating part 31 of the heating piece to heat and atomize. When the user draws the electronic cigarette, exterior air flows into A1 and A2 areas in the gas pathway 50 from the air inlet hole 112, flowing downwardly to the gas-outlet pathway 114, bearing the atomizing mist atomized by the heating piece near the gas-outlet pathway 114 into the gas-outlet pathway 114, further being drawn by the user. In this case, the heater 30 and the gas pathway 50 are both above the reservoir 40, condensed or incomplete-atomized tobacco liquid will directly settle to the liquid conductor 20, further to the reservoir through the liquid conductor 20, rather than flowing into the gas pathway 50, which may effectively resolve the leakage problem of tobacco liquid and improve user experience.

Understandable, in some embodiments, when assembling the atomizer 1, firstly receiving the liquid conductor 20 into the first receiving hole 124, as used herein, the liquid conductor 20 tightly abuts inside the first receiving hole 124 and is partly received in the groove of the second base 123. Secondly, disposing the heating piece 30 in the groove, with that the heating part 31 is matched with the liquid conductor 20 and the fixing hole 321 of the fixing part 32 is matched with the second receiving hole 125. Thirdly, the protrusion 62 of the electrode mast 60 passing through the fixing hole 321 and the second receiving hole 125 to rivet with the second receiving hole 125, while the lid 61 fixes the fixing part 32 to the second base 123. And the heating part 31 of the heating piece compasses the liquid conductor 20 to abut against the liquid conductor 20, to finish the assembling of the base 12. Then, the base 12 is assembled in the receiving hole 111 to rivet the first base 121 and the second base 123 with inner walls of the receiving chamber 111. In this case, the second base 123 is near the gas-outlet pathway 114, the second base 123 and the shell 11 encompass the gas pathway 50, and the gas pathway 50 intercommunicates with the air inlet 112 and the aerosol outlet 113. The second base 123, the extending portion 122, the first base 121 and the shell 11 encompass the reservoir 40 disposed below the gas pathway 50. Finally, replenishing tobacco liquid to the reservoir 40 via the injection hole 12111, after replenishing, the injection plug 70 is assembled in the injection hole 1211, next sealing up the injection hole 1211 to finish the assembling of the atomizer 1.

Additional aspects and advantages of the present disclosure will be: comparing with the prior art, the present disclosure relates to an atomizer and an electronic cigarette having the same. The atomizer includes: an atomizing body, a heater and a liquid conductor. As used herein, the atomizing body of the atomizer has a reservoir for storing tobacco liquid, a gas pathway, an air inlet and an aerosol outlet. The gas pathway is disposed above the reservoir, intercommunicating with the air inlet and the aerosol outlet. The liquid conductor is received in the reservoir. The heater is disposed in the gas pathway to contact the liquid conductor. The tobacco liquid in the reservoir can only be guided to the heater for heating and atomizing under capillary action of the liquid conductor. And the liquid conductor is not easy to get saturated under capillary action, thus alleviating a phenomenon of gravity sedimentation due to too much tobacco liquid in the liquid conductor. Furthermore, the liquid conductor is disposed in the reservoir and the tobacco liquid absorbed by the liquid conductor will settle to the reservoir under gravity force, rather than flowing into the gas pathway to cause leakage of the tobacco liquid, which effectively resolve the leakage problem of the tobacco liquid and improves the user experience.

Embodiment 5

The present disclosure relates to an electronic cigarette, the electronic cigarette (not shown) includes a power supply module (not shown) and the aforementioned atomizer 1, the power supply module is detachably connected with the atomizer 1.

More specifically, the power supply module is connected with the electrode mast 60, permitting the power supply module to supply power to the heating piece via the electronic mast 60, further the heating piece may heat and atomize the tobacco liquid.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer comprising:

an atomizing body, having a proximal end, a distal end opposite to the proximal end, a longitudinal axis between the proximal end and the distal end, and a transverse axis that is perpendicular to the longitudinal axis;

an aerosol outlet adjacent to the proximal end of the atomizing body, an air inlet being bored at a lateral surface of the atomizing body, a gas pathway within the atomizing body and adjacent to the proximal end of the atomizing body, the gas pathway intercommunicating with the air inlet and the aerosol outlet;

a reservoir within the atomizing body and adjacent to the distal end of the atomizing body, the reservoir configured to store tobacco liquid;

a heater configured for heating the tobacco liquid to generate an aerosol, the heater being disposed inside the gas pathway;

a liquid conductor extending towards the proximal end of the atomizing body to contact the heater in the gas pathway and extending towards the distal end of the atomizing body to absorb tobacco liquid from the reservoir, such that the liquid conductor is capable of supplying tobacco liquid to the heater;

wherein the heater comprises a hollow aerosol pathway formed therein to intercommunicate with the gas pathway; and the liquid conductor comprises a main portion and an extending portion, the main portion surrounding a periphery of the heater, the extending portion extending to the reservoir and configured for absorbing tobacco liquid to the main portion such that the main portion is capable of supplying tobacco liquid to the heater.

2. The atomizer according to claim 1, wherein the atomizing body comprises:

a shell having a receiving chamber formed therein, an air inlet and an aerosol outlet being formed on the shell;

a base, received in the receiving chamber and sealed up with the shell;

a fixing component, received in the receiving chamber and the gas pathway being disposed inside the fixing component; and the shell, the base and the fixing component defining the reservoir.

3. The atomizer according to claim 1, wherein the gas pathway comprises: a gas-inlet pathway and a gas-outlet pathway;

the gas-inlet pathway intercommunicates with the air inlet, the gas-outlet pathway intercommunicates with the aerosol outlet.

4. The atomizer according to claim 3, wherein the gas-inlet pathway is extending in a direction of the transverse axis; the gas-outlet pathway is extending in a direction of the longitudinal axis;

the liquid conductor surrounding the heater is nested within the gas-inlet pathway;

the gas-inlet pathway is bored with a first slot that intercommunicates with the gas-inlet pathway; the extending portion passing through the first slot is extending to the reservoir.

5. The atomizer according to claim 4, wherein the heater is a heating tube bored with multiple openings, the heater heats the tobacco liquid to generate an aerosol that is expelled to an atomizing pathway via the multiple openings;

the heating tube is provided with a first through hole whereby the atomizing pathway intercommunicates with the gas-outlet pathway.

6. The atomizer according to claim 4, wherein a number of the air inlets is two, two air inlets being a first air inlet and a second air inlet;

the atomizer further comprises: a first plug and a second plug;

the first plug is engaged with the first air inlet, the first plug is opened with a second through hole; the first air inlet, the second through hole and the atomizing pathway intercommunicate with each other;

the second plug is engaged with the second air inlet, the second plug is opened with a third through hole; the second air inlet, the third through hole and the atomizing pathway intercommunicate with each other.

7. The atomizer according to claim 4, wherein the gas-outlet pathway has a V-shaped longitudinal section.

8. The atomizer according to claim 3, wherein the gas-inlet pathway comprises a first gas-inlet pathway and a second gas-inlet pathway;

the second gas-inlet pathway extends along a direction of the transverse axis; the first gas-inlet pathway and the gas-outlet pathway both extend along a direction of the longitudinal axis;

the first gas-inlet pathway intercommunicates with the air inlets; the second gas-inlet pathway is bored with a second slot.

9. The atomizer according to claim 8, wherein the heater is a heating coil that is nested within the second gas-inlet pathway, and the atomizing pathway formed inside of the heating coil intercommunicates with the second gas-inlet pathway.

10. The atomizer according to claim 8, wherein, the atomizer further comprises a clamping component;

the clamping component comprises a third slot and a fourth through hole;

the main portion of the liquid conductor surrounding the heating coil is fixed by the clamping component, the atomizing pathway corresponding with the fourth through hole; the extending portion passes through the third slot to extend into the reservoir;

the clamping component passes through the second slot to be nested within the second gas-inlet pathway.

11. The atomizer according to claim 10, wherein the second gas-inlet pathway is bored with an opening;

the atomizer further comprises a third plug, the third plug engaged with the opening for cleaning the gas pathway.

12. An atomizer comprising:

an atomizing body, having a proximal end, a distal end opposite to the proximal end, a longitudinal axis between the proximal end and the distal end, and a transverse axis that is perpendicular to the longitudinal axis;

an aerosol outlet adjacent to the proximal end of the atomizing body, an air inlet being bored at a lateral surface of the atomizing body, a gas pathway within the atomizing body and adjacent to the proximal end of the atomizing body, the gas pathway intercommunicating with the air inlet and the aerosol outlet;

a reservoir within the atomizing body and adjacent to the distal end of the atomizing body, the reservoir configured to store tobacco liquid;

a heater configured for heating the tobacco liquid to generate an aerosol, the heater being disposed inside the gas pathway;

a liquid conductor extending towards the proximal end of the atomizing body to contact the heater in the gas pathway and extending towards the distal end of the atomizing body to absorb tobacco liquid from the reservoir, such that the liquid conductor is capable of supplying tobacco liquid to the heater;

wherein the atomizing body comprises:

a shell having a receiving chamber formed therein, an air inlet and an aerosol outlet formed thereon;

a base comprising a first base, an extending portion and a second base, the extending portion disposed between the first base and the second base, a length of the extending portion being less than lengths of the first base along a direction of the transverse axis; and the base being received in the receiving chamber, the first base and the second base being sealed up with the shell; the second base and the shell encompassing the gas pathway; the second base, the first base, the extending portion and the shell together defining an annular reservoir.

13. The atomizer according to claim 12, wherein the base comprises a first receiving hole, the first receiving hole passing through the extending portion and the second base;

the liquid conductor is received in the first receiving hole.

14. The atomizer according to claim 13, wherein the extending portion is bored with a liquid conductive hole, the liquid conductive hole intercommunicating with the first receiving hole and the reservoir such that the liquid conductive hole absorbs tobacco liquid from the reservoir through the liquid conductive hole.

15. The atomizer according to claim 12, wherein, the heater is a disk-shaped heating piece;

the heating piece comprises a heating part and a fixing part;

the heating piece is fixed on the second base via the fixing part, the heating part abutting the liquid conducting body.

16. The atomizer according to claim 15, wherein the fixing part is bored with a fixing hole;

the base is bored with a second receiving hole, the second receiving hole passing through the first base, the extending portion and the second base;

the second receiving hole corresponds to the fixing hole.

17. The atomizer according to claim 16, further comprising:

an electrode mast, the electrode mast passing through the fixing hole and the second receiving hole and configured for fixing the heating piece to the second base and coupling the heating piece to a power supply module.

18. The atomizer according to claim 17, wherein the first base is bored with an injection hole configured for replenishing tobacco liquid to the reservoir.

19. An electronic cigarette comprising:

an atomizer comprising:

an atomizing body, having a proximal end, a distal end opposite to the proximal end, a longitudinal axis between the proximal end and the distal end, and a transverse axis that is perpendicular to the longitudinal axis;

an aerosol outlet adjacent to the proximal end of the atomizing body; an air inlet bored at a lateral surface of the atomizing body; a gas pathway within the atomizing body and adjacent to the proximal end of the atomizing body; the gas pathway intercommunicating with the air inlet and the aerosol outlet;

a reservoir within the atomizing body and adjacent to the distal end of the atomizing body, the reservoir configured to store tobacco liquid;

a heater, configured for heating the tobacco liquid to generate an aerosol; the heater disposed inside the gas pathway;

a liquid conductor, extending towards the proximal end of the atomizing body to contact the heater in the gas pathway and extending towards the distal end of the atomizing body to absorb tobacco liquid from the reservoir, such that the liquid conductor is capable of supplying tobacco liquid to the heater; and wherein the electronic cigarette further comprises a power supply module coupled with the atomizer and configured for supplying power to the atomizer;

wherein the heater comprises a hollow aerosol pathway formed therein to intercommunicate with the gas pathway; and the liquid conductor comprises a main portion and an extending portion, the main portion surrounding a periphery of the heater, the extending portion extending to the reservoir and configured for absorbing tobacco liquid to the main portion such that the main portion is capable of supplying tobacco liquid to the heater.

* * * * *